US006911268B2

(12) United States Patent
Takada et al.

(10) Patent No.: US 6,911,268 B2
(45) Date of Patent: Jun. 28, 2005

(54) HIGH STRENGTH HOT-DIP GALVANIZED OR GALVANNEALED STEEL SHEET HAVING IMPROVED PLATING ADHESION AND PRESS FORMABILITY AND PROCESS FOR PRODUCING THE SAME

(75) Inventors: Yoshihisa Takada, Kitakyushu (JP); Masayoshi Suehiro, Kitakyushu (JP); Takehide Senuma, Futtsu (JP)

(73) Assignee: Nippon Steel Corporation, Tokyo (JP)

( * ) Notice: Subject to any disclaimer, the term of this patent is extended or adjusted under 35 U.S.C. 154(b) by 153 days.

(21) Appl. No.: 10/465,982

(22) PCT Filed: Dec. 27, 2001

(86) PCT No.: PCT/JP01/11569

§ 371 (c)(1),
(2), (4) Date: Jun. 27, 2003

(87) PCT Pub. No.: WO02/055751

PCT Pub. Date: Jul. 18, 2002

(65) Prior Publication Data

US 2004/0055667 A1 Mar. 25, 2004

(30) Foreign Application Priority Data

Dec. 29, 2000 (JP) ..... 2000-404991
Mar. 30, 2001 (JP) ..... 2001-102186

(51) Int. Cl.[7] ..... B32B 15/18; C21D 9/46

(52) U.S. Cl. ..... 428/659; 428/939; 148/533; 148/534

(58) Field of Search ..... 428/659, 939; 148/533, 534; 427/383.7, 433, 437

(56) References Cited

U.S. PATENT DOCUMENTS 6,517,955 B1 * 2/2003 Takada et al. ..... 428/659

FOREIGN PATENT DOCUMENTS

JP 11-279682 10/1999
JP 11-279691 10/1999

OTHER PUBLICATIONS

K. Eberle, et al., "New thermomechanical strategy for production of high strength low alloyed multiphase steel showing transformation induced plasticity effect", Ironmaking & Steelmaking, vol. 26, No. 3, received on Oct. 5, 1999, (at JICST), pp. 176–181.

* cited by examiner

*Primary Examiner*—Robert R. Koehler
(74) *Attorney, Agent, or Firm*—Kenyon & Kenyon

(57) ABSTRACT

Disclosed are a high strength hot-dip galvanized or galvannealed steel sheet, which has improved press formability and plating adhesion and is useful as a member for automobile, building, electric or other members, and a process for producing the same.

This high strength hot-dip galvanized or galvannealed steel sheet comprises: (a) a steel sheet substrate comprising, by weight, carbon (C): 0.05 to 0.2%, silicon (Si): 0.2 to 2.0%, manganese (Mn): 0.2 to 2.5%, and aluminum (Al): 0.01 to 1.5%, the silicon and the aluminum having a mutual relationship represented by formula $0.4(\%) \leqq Si + 0.8\ Al(\%) \leqq 2.0(\%)$, the steel sheet substrate further comprising at least one member selected from the group consisting of (i) 0.003 to 1.0% of tin (Sn), (ii) 0.005 to 1.0% in total of at least one member selected from antimony (Sb), bismuth (Bi), and selenium (Se), (iii) 0.005 to 1.0% in total of at least one member selected from beryllium (Be), magnesium (Mg), calcium (Ca), and zirconium (Zr), and (iv) 0.005 to 1.0% in total of at least one member selected from scandium (Sc), yttrium (Y), lanthanum (La), and cerium (Ce), with the balance consisting of iron (Fe) and unavoidable impurities, the volume fraction of retained austenite in the steel structure being 2 to 20%; and (b) a zinc (Zn) coating layer provided on said steel sheet substrate.

9 Claims, No Drawings

HIGH STRENGTH HOT-DIP GALVANIZED OR GALVANNEALED STEEL SHEET HAVING IMPROVED PLATING ADHESION AND PRESS FORMABILITY AND PROCESS FOR PRODUCING THE SAME

BACKGROUND OF THE INVENTION

1. Field of the Invention

The present invention relates to a high strength steel sheet useful as automobile, building, electric or other members and a process for producing the same. More particularly, the present invention relates to a high strength hot-dip galvanized steel sheet which has improved bulging formability at the time of press forming and improved plating adhesion and a process for producing the same. The term "high strength hot-dip galvanized or galvannealed steel sheet" as used herein includes high strength hot-dip galvanized steel sheets (GI) and high strength hot-dip galvannealed steel sheets (GA).

2. Background Art

To meet a demand for lower fuel consumption of automobiles and the like in recent years, studies have been made on a weight reduction of members such as cross members and side members of automobiles and the like. Regarding materials, studies on an increase in strength have been made from the viewpoint of ensuring strength even in reduced thickness of members.

In general, however, increasing the strength of materials results in deteriorated press formability of the materials. Therefore, in order to realize the weight reduction of the above members, steel sheets capable of simultaneously satisfying good press formability and high strength are required, and the development of such steel sheets has been desired in the art.

Among index values for formability are included elongation and, in addition, n value and r value in tensile tests. At ask to be accomplished in recent years is to simplify the step of pressing through one-piece molding. Therefore, what is particularly important is that the n value corresponding to uniform elongation is large.

To this end, hot rolled steel sheets or cold rolled steel sheets, which utilize transformation induced plasticity of retained austenite present in steel, have been developed. In these steel sheets, only about 0.07 to 0.4% of carbon (C), about 0.3 to 2.0% of silicon (Si), and about 0.2 to 2.5% of manganese (Mn) are used as basic alloying elements without incorporating any expensive alloying element, and heat treatment characterized by, after annealing in a two-phase region, performing bainite transformation at a temperature of about 300 to 450° C. is carried out to allow retained austenite to exist in the metallurgical structure. These steel sheets are disclosed, for example, in Japanese Patent Laid-Open Nos. 230715/1989 and 217425/1990.

Steel sheets, to which the above technique can be applied, are not limited to cold rolled steel sheets produced by continuous annealing. For example, Japanese Patent Laid-Open No. 79345/1989 discloses that this technique can also be applied to hot rolled steel sheets by controlling cooling temperature of a coiling or a runout table.

The production of automobiles of higher grade has led to a tendency toward coating of automobile members with a view to improving corrosion resistance and appearance. At the present time, galvanized steel sheets are used in most of the automobile members except for specific members mounted within the automobiles. Accordingly, from the viewpoint of corrosion resistance, coating which is useful for these steel sheets is hot-dip galvanizing, or hot-dip galvannealing wherein, after hot-dip galvanizing, alloying treatment is carried out. Among these high-tensile steel sheets, steel sheets having a high silicon content are likely to form an oxide film on the surface thereof. This poses problems including that very small non-coated sites occur in hot-dip galvanizing, or plating adhesion of the worked part after the completion of alloying is deteriorated. Thus, at the present time, any high-silicon-base high-tensile and high-ductile hot-dip galvannealed steel sheets possessing excellent plating adhesion of the worked part and, at the same time, excellent corrosion resistance have not been put into practical use.

In the steel sheets disclosed, for example, in Japanese Patent Laid-Open Nos. 230715/1989 and 217425/1990, however, it should be noted that 0.3 to 2.0% of silicon is contained and the retained austenite is ensured by utilizing unique bainite transformation of the steel. Therefore, the contemplated metallurgical structure cannot be provided without considerably close control of cooling after annealing in an intercritical temperature range or holding in a temperature range of about 300 to 450° C., and strength and elongation disadvantageously deviate from the target range.

This heat history can be realized on a commercial scale by continuous annealing equipment or a runout table after hot rolling and the step of coiling. Since, however, the transformation of austenite is rapidly completed at 450 to 600° C., control should be carried out so that the residence time is short particularly at 450 to 600° C. Further, even at 350 to 450° C., the metallurgical structure undergoes a significant change depending upon the holding time. Therefore, when the heat treatment conditions have deviated from predetermined conditions, only unsatisfactory strength and elongation are provided.

Further, since the residence time at 450 to 600° C. is long and a large amount of silicon, which deteriorates suitability for coating, is contained as an alloying element, the production of a coated steel sheet by passing the steel sheet through hot-dip galvanizing equipment is impossible. After all, poor surface corrosion resistance of the steel sheet containing about 0.3 to 2.0% of silicon disadvantageously hinders the widespread commercial use of the steel sheets.

In order to solve the above problem, for example, Japanese Patent Laid-Open Nos. 247586/1993 and 145788/1994 disclose steel sheets having suitability for coating improved by regulating the content of silicon. In the technique disclosed in the above publications, retained austenite is formed by adding aluminum (Al) instead of silicon. However, as with silicon, aluminum is more likely to be oxidized than iron (Fe). Specifically, aluminum is likely to form an oxide film on the surface of the steel sheet. Therefore, disadvantageously, satisfactory plating adhesion cannot be ensured.

Further, for example, Japanese Patent Laid-Open Nos. 333552/1992 and 346644/1992 disclose a hot-dip galvannealing method for a high-silicon-base high-strength steel sheet. In this method, after pre-coating of nickel (Ni), the pre-coated steel sheet is rapidly heated at a low temperature and is subjected to hot-dip galvanizing, followed by alloying treatment. Since, however, this method requires nickel pre-coating, disadvantageously, equipment for nickel pre-coating should be newly provided.

SUMMARY OF THE INVENTION

The present inventors have made studies on the solution of the above problems of the prior art and on an improvement in surface corrosion resistance and, as a result, have found the chemical composition and characteristics of the metallurgical structure of a high strength steel sheet which can be produced even in hot-dip galvanizing equipment and has good press formability.

An object of the present invention is to solve the above problems of the prior art and to provide a high strength hot-dip galvanized or galvannealed steel sheet possessing good press formability and plating adhesion and a production process which can efficiently produce this steel sheet.

The present inventors have made extensive and intensive studies on the relationship between suitability for coating and steel constituents with a view to providing a high strength hot-dip galvanized or galvannealed steel sheet and a production process thereof which can attain the above object of the present invention. This has led to the completion of the present invention.

(1) According to the present invention, there is provided a high strength hot-dip galvanized or galvannealed steel sheet having improved plating adhesion and press formability, said steel sheet comprising:

(a) a steel sheet substrate comprising, by weight, carbon (C): 0.05 to 0.2%, silicon (Si): 0.2 to 2.0%, manganese (Mn): 0.2 to 2.5%, and aluminum (Al): 0.01 to 1.5%, said silicon and said aluminum having a mutual relationship represented by formula $$0.4(\%) \leqq Si+0.8Al\ (\%) \leqq 2.0\%,$$

said steel sheet substrate further comprising at least one member selected from the group consisting of (i) 0.003 to 1.0% of tin (Sn), (ii) 0.005 to 1.0% in total of at least one member selected from antimony (Sb), bismuth (Bi), and selenium (Se), (iii) 0.005 to 1.0% in total of at least one member selected from beryllium (Be), magnesium (Mg), calcium (Ca), and zirconium (Zr), and (iv) 0.005 to 1.0% in total of at least one member selected from scandium (Sc), yttrium (Y), lanthanum (La), and cerium (Ce), with the balance consisting of iron (Fe) and unavoidable impurities, the volume fraction of retained austenite in the steel structure being 2 to 20%; and (b) a zinc (Zn) coated layer provided on said steel sheet substrate.

(2) In a preferred embodiment of the present invention, said steel sheet substrate further comprises, by weight, at least one member selected from nickel (Ni): not more than 2.0%, copper (Cu): not more than 2.0%, and cobalt (Co): less than 0.3%.

(3) In a preferred embodiment of the present invention, said steel sheet substrate further comprises, by weight, at least one member selected from molybdenum (Mo): less than 0.5%, chromium (Cr): less than 1.0%, vanadium (V): less than 0.3%, titanium (Ti):less than 0.06%, niobium (Nb): less than 0.06%, and boron (B): less than 0.01%.

(4) In a preferred embodiment of the present invention, said zinc coated layer is a galvannealed layer comprising zinc (Zn): 80 to 91%, iron (Fe): 8 to 15%, and aluminum (Al) not more than 1%.

(5) In a preferred embodiment of the present invention, said zinc coated layer is a galvanized layer comprising zinc: not less than 80% and aluminum: not more than 1%.

(6) According to the present invention, there is provided a process for producing the above hot-dip galvanized or galvannealed steel sheet having a galvannealed layer of the present invention, said process comprising the steps of:

providing a cold rolled steel sheet having the above chemical composition of the steel sheet substrate;

annealing the cold rolled steel sheet for 10 sec to 6 min in the intercritical temperature range of 650 to 900° C., then cooling the annealed steel sheet to 350 to 500° C. at a cooling rate of 2 to 200° C./sec, and subjecting the cooled steel sheet to hot-dip galvannealing process; and then holding the coated steel sheet in the temperature range of 450 to 600° C. for 5 sec to 2 min and then cooling the coated steel sheet to 250° C. or below at a cooling rate of not less than 5° C./sec.

(7) According to the present invention, there is provided another process for producing the above hot-dip galvanized or galvannealed steel sheet having a hot-dip galvannealed layer of the present invention, said process comprising the steps of:

providing a cold rolled steel sheet having the above chemical composition of the steel sheet substrate;

annealing the cold rolled steel sheet for 10 sec to 6 min in the intercritical temperature range of 650 to 900° C., then cooling the annealed steel sheet to 350 to 500° C. at a cooling rate of 2 to 200° C./sec, holding the cooled steel sheet in said cooling temperature range for not more than 10 min, and then subjecting the cooled steel sheet to hot-dip galvannealed process; and then holding the coated steel sheet in the temperature range of 450 to 600° C. for 5 sec to 2 min and then cooling the coated steel sheet to 250° C. or below at a cooling rate of not less than 5° C./sec.

(8) According to the present invention, there is provided a process for producing the above hot-dip galvanized or galvannealed steel sheet having a galvanized layer of the present invention, said process comprising the steps of:

providing a cold rolled steel sheet having the above chemical composition of the steel sheet substrate;

annealing the cold rolled steel sheet for 10 sec to 6 min in the intercritical temperature range of 650 to 900° C., then cooling the annealed steel sheet to 350 to 500° C. at a cooling rate of 2 to 200° C./sec, and subjecting the cooled steel sheet to hot-dip galvanizing process; and then cooling the coated steel sheet to 250° C. or below at a cooling rate of not less than 5° C./sec.

(9) According to the present invention, there is provided another process for producing the above hot-dip galvanized or galvannealed steel sheet having a galvanized layer of the present invention, said process comprising the steps of:

providing a cold rolled steel sheet having the above chemical composition of the steel sheet substrate;

annealing the cold rolled steel sheet for 10 sec to 6 min in the intercritical temperature range of 650 to 900° C., then cooling the annealed steel sheet to 350 to 500° C. at a cooling rate of 2 to 200° C./sec, holding the cooled steel sheet in said cooling temperature range for not more than 10 min, and then subjecting the cooled steel sheet to hot-dip galvanizing process; and then cooling the coated steel sheet to 250° C. or below at a cooling rate of not less than 5° C./sec.

DETAILED DESCRIPTION OF THE INVENTION (a) Steel Sheet Substrate

In the steel sheet substrate according to the present invention, the chemical composition is limited from the viewpoint of providing high strength hot-dip galvanized or galvannealed steel sheets possessing good press formability and good plating adhesion. The reasons for the limitation of the chemical composition will be described in detail.

Basic Constituents

Carbon (C) is an austenite stabilizer. In the intercritical temperature range and in the bainite transformation temperature range, carbon migrates from ferrite and is enriched in austenite. As a result, even after cooling to room temperature, 2 to 20% of chemically stabilized austenite is present and improves formability through transformation induced plasticity. If the content of carbon is less than 0.05%, then it is difficult to ensure not less than 2% of retained austenite, making it impossible to attain the contemplated effect. On the other hand, a carbon content exceeding 0.2% should be avoided, because the weldability is deteriorated.

Silicon (Si) does not dissolve in cementite and suppresses the precipitation of cementite. By virtue of this action, the transformation from austenite to cementite at 350 to 600° C. is delayed, during which time the enrichment of carbon in austenite is promoted. This can enhance the chemical stability of austenite, causes transformation induced plasticity, and thus enables retained austenite, which can improve the formability, to be ensured. If the content of silicon is less than 0.2%, then the effect of silicon cannot be attained. On the other hand, when the silicon content is excessively high, the suitability for coating is deteriorated. Therefore, the silicon content should be not more than 2.0%.

Manganese (Mn) is an austenite former. Further, manganese can prevent the decomposition of austenite to pearlite in the course of cooling to 350 to 600° C. after annealing in the intercritical temperature range. Therefore, manganese acts so that retained austenite is contained in the metallurgical structure after cooling to room temperature. When the content of manganese is less than 0.2%, in order to prevent the decomposition of austenite to pearlite, the cooling rate should be increased to such a level that could not be controlled on a commercial scale. This is disadvantageous. On the other hand, when the manganese content exceeds 2.5%, the formation of a banded structure is significant, resulting in deteriorated properties of the steel sheet. Further, in this case, upon spot welding, the spot weld zone is disadvantageously likely to be broken within the nugget. Furthermore, increasing the manganese content deteriorates the suitability for coating.

Aluminum (Al) is used as a deoxidizer. At the same time, as with silicon, aluminum does not dissolve in cementite and, in holding the steel sheet at 350 to 600° C., suppresses the precipitation of cementite and delays the transformation from austenite to cementite. Since, however, aluminum has higher ferrite forming ability than silicon, the transformation starts in an earlier stage. In this case, even when the holding time is very short, carbon is enriched in austenite from the start of annealing in the intercritical temperature range. This can enhance the chemical stability, and thus, the amount of martensite, which deteriorates the formability, present in the metallurgical structure after cooling to room temperature is very small. Therefore, the coexistence of aluminum and silicon can reduce a change in strength and elongation depending upon conditions for holding at 350 to 600° C., and steel sheets having a combination of high strength with good press formability can be easily provided. For attaining the above effect, the addition of aluminum in an amount of not less than 0.01% is necessary. The addition of aluminum in an amount of not less than 0.1% is preferred. In addition, aluminum, together with silicon, should be added so that the content of "Si+0.8Al" is not less than 0.4%. On the other hand, as with the case of silicon, an aluminum content exceeding 1.5% deteriorates plating adhesion and thus should be avoided. Furthermore, from the viewpoint of ensuring the plating adhesion, aluminum, together with silicon, should be added so that the content of "Si+0.8Al" is not more than 2.0%.

Selective Basic Constituents

Tin (Sn), antimony (Sb), bismuth (Bi), selenium (Se), beryllium (Be), magnesium (Mg), calcium (Ca), zirconium (Zr), scandium (Sc), yttrium (Y), lanthanum (La), and cerium (Ce) are elements which are most important to the present invention. The addition of at least one of these elements can improve the wettability and the plating adhesion of the steel sheet by hot-dip galvanizing or galvannealing. As a result, steel sheets having excellent suitability for coating and formability can be produced.

In steel sheets containing silicon and aluminum, when coated steel sheets are produced in a continuous hot-dip galvanizing line, oxides of silicon and aluminum are formed on the surface of the steel sheets, resulting in deteriorated plating adhesion. However, the addition of at least one of the above elements can improve the suitability of the steel sheets for coating.

In a preferred embodiment of the present invention, tin is added in an amount of 0.003 to 1.0%. In steel sheets containing silicon and aluminum, when coated steel sheets are produced in a continuous hot-dip galvanizing line, oxides of silicon and aluminum are formed on the surface of the steel sheets and deteriorate the plating adhesion to the steel sheets. However, since tin is an element which is less likely to be oxidized than iron and, at the same time, is likely to segregate on the surface of steel sheets, tin is enriched in the surface layer of the steel sheets to suppress the formation of oxides of silicon and aluminum, whereby the deterioration in plating adhesion is prevented. When the content of tin is less than 0.003%, satisfactory plating adhesion cannot be provided in the steel of the present invention. When more significant development of the above effect is desired, the addition of tin in an amount of not less than 0.005% is preferred. The amount of tin added is more preferably not less than 0.008%. On the other hand, when tin is added in an amount of more than 1.0%, cracking disadvantageously occurs at the time of hot rolling. As a result, good appearance of coating cannot be ensured. When better appearance of coating is desired, the addition of tin in an amount of not more than 0.5% is preferred.

In another preferred embodiment of the present invention, 0.005 to 1.0% in total of at least one of antimony, bismuth, and selenium is added. Antimony, bismuth, and selenium are likely to cause surface segregation and thus are enriched in the surface layer of the steel sheet to suppress the formation of oxides of silicon and aluminum. Consequently, even in the case of high-silicon and/or high-aluminum steel, the deterioration in plating adhesion can be prevented. This effect can be attained by adding at least one of antimony, bismuth, and selenium. When the total amount of antimony, bismuth, and selenium is not less than 0.005%, satisfactory plating adhesion can be provided. When a further improved effect is desired, the addition of at least two of these elements in a total amount of not less than 0.008% is preferred. The addition of more than 1.0% in total of at least one of antimony, bismuth, and selenium causes surface segregation of these elements in an excessive amount. As a result, good appearance of coating cannot be ensured. In order to maintain good appearance of coating, the addition of not more than 0.5% in total of at least one of antimony, bismuth, and selenium is preferred.

As with antimony, bismuth, and selenium, arsenic (As) tellurium (Te), polonium (Po), and germanium (Ge) can improve suitability of the steel sheet for coating. Since, however, arsenic (As), tellurium (Te), polonium (Po), and germanium (Ge) are toxic elements and are very high in cost, these elements are excluded from the additive elements in the present invention.

In still another preferred embodiment of the present invention, 0.005 to 1.0% in total of at least one of beryllium (Be), magnesium (Mg), calcium (Ca), and zirconium (Zr) is added. Since beryllium (Be), magnesium (Mg), calcium (Ca), and zirconium (Zr) are very likely to form oxides, they can suppress the formation of silicon oxide and/or aluminum oxide which deteriorate suitability of high-silicon steel and/or high-aluminum steel for coating. This contributes to an improvement in suitability for coating. This effect can be attained by adding at least one of beryllium (Be), magnesium (Mg), calcium (Ca), and zirconium (Zr). The addition of not less than 0.005% in total of at least one of beryllium (Be), magnesium (Mg), calcium (Ca), and zirconium (Zr) can provide satisfactory plating adhesion. When a further improved effect is desired, the addition of at least two of these elements in a total amount of not less than 0.008% is preferred. The addition of more than 1.0% in total of at least one of beryllium (Be), magnesium (Mg), calcium (Ca), and zirconium (Zr) results in an increased amount of the formation of oxides of these elements and consequently makes it impossible to ensure good appearance of coating.

In a further preferred embodiment of the present invention, 0.005 to 1.0% in total of at least one of scandium (Sc), yttrium (Y), lanthanum (La), and cerium (Ce) is added. Since scandium (Sc), yttrium (Y), lanthanum (La), and cerium (Ce) are also likely to form oxides, they can suppress the formation of silicon oxide and/or aluminum oxide which deteriorate suitability of high-silicon steel and/or high-aluminum steel for coating. This contributes to an improvement in suitability for coating. Further, at the time of oxidation, scandium (Sc), yttrium (Y), lanthanum (La), and cerium (Ce) vigorously act on surface irregularities of the steel sheet. This contributes to improved plating adhesion. This effect can be attained by adding at least one of scandium (Sc), yttrium (Y), lanthanum (La), and cerium (Ce). The addition of not less than 0.005% in total of at least one of scandium (Sc), yttrium (Y), lanthanum (La), and cerium (Ce) can provide satisfactory plating adhesion. When a further improved effect is desired, the addition of at least two of these elements in a total amount of not less than 0.008% is preferred. The addition of more than 1.0% in total of at least one of scandium (Sc), yttrium (Y), lanthanum (La), and cerium (Ce) results in the formation of an increased amount of oxides of these elements and consequently makes it impossible to ensure good appearance of coating.

As with scandium (Sc), yttrium (Y), lanthanum (La), and cerium (Ce), rare earth elements such as neodymium (Nd), gadolinium (Gd), and dysprosium (Dy) can improve the suitability for coating. These elements, however, are very high in cost and thus are excluded from additive elements in the present invention.

Further, the addition of a combination of two or more members, which are different from each other or one another in effect, selected from the group consisting of (i) tin (Sn), (ii) at least one member selected from antimony (Sb), bismuth (Bi), and selenium (Se), (iii) at least one member selected from beryllium (Be), magnesium (Mg), calcium (Ca), and zirconium (Zr), and (iv) at least one member selected from scandium (Sc), yttrium (Y), lanthanum (La), and cerium (Ce) can ensure better suitability for coating.

The addition of not less than 0.005% in total of at least one of these elements can provide satisfactory plating adhesion. When the total amount of at least one of these elements exceeds 1.0%, good appearance of coating cannot be ensured.

Optional Constituents

In the steel sheet according to the present invention, the above-described elements constitute basic constituents. In addition to these elements and iron, for example, at least one of nickel (Ni), copper (Cu), and cobalt (Co), which are austenite formers and, at the same time, can improve strength and plating adhesion, may be added. Also, at least one of molybdenum (Mo), chromium (Cr), vanadium (V), boron (B), titanium (Ti), niobium (Nb), and boron (B), which are hardenability improving elements (constituent (a) group), and/or at least one of REM (rare earth metal), calcium (Ca) zirconium (Zr), and magnesium (Mg), which reduce inclusions (constituent (b) group), may be added optionally together with at least one of the above-described elements, that is, nickel, copper, and cobalt, to the above basic constituents.

The reasons for the limitation of the contents of the above elements in the steel sheet will be described in detail.

Nickel (Ni), copper (Cu), and cobalt (Co), as with tin (Sn), are less likely to be oxidized than iron and thus are enriched on the surface of the steel sheet at the time of annealing to suppress the formation of oxides of silicon (Si), aluminum (Al) and the like which inhibit plating adhesion. Further, nickel (Ni), copper (Cu), and cobalt (Co), as with manganese (Mn), are austenite formers and, at the same time, as with silicon (Si) and aluminum (Al), do not dissolve in cementite. Therefore, in holding the steel sheet at 350 to 600° C., nickel (Ni), copper (Cu), and cobalt (Co) suppress the precipitation of cementite and delay the progress of transformation. Therefore, the addition of at least one of nickel (Ni), copper (Cu), and cobalt (Co) can provide better steel sheets. When nickel is added in an amount exceeding 2.0%, the contemplated effect is saturated. For this reason, the upper limit of the nickel content is 2.0%. When copper (Cu) is added in an amount exceeding 2.0%, the quality of the steel sheet is deteriorated as a result of precipitation of copper (Cu). For this reason, the upper limit of the copper content is 2.0%. Since cobalt (Co) is an expensive metal, the upper limit of the cobalt content is 0.3%. When tin and copper (Co) are added in combination, preferably, tin and copper satisfy a mutual relationship represented by formula "Sn(%)+Cu(%) <3×Ni(%)" from the viewpoint of preventing hot cracking caused by tin and copper.

Molybdenum (Mo), chromium (Cr), vanadium (V), titanium (Ti), niobium (Ni), and boron (B) are strength improving elements, and REM, calcium (Ca), zirconium (Zr), and magnesium (Mg) are elements which combine with sulfur in the steel to reduce inclusions, thereby ensuring good elongation of the steel. Preferably, the steel sheet substrate further comprises molybdenum (Mo): less than 0.5%, chromium (Cr): less than 1.0%, vanadium (V): less than 0.3%, titanium (Ti): less than 0.06%, niobium (Nb): less than 0.06%, and boron (B): less than 0.01%. The effect of these elements is saturated when these elements are added in the upper limit amount. When the above elements are added in an amount exceeding the upper limit, the cost is increased. Therefore, when these elements are added, the amounts of the elements added should be not more than the above respective upper limits.

When phosphorus (P), sulfur (S), nitrogen (N), oxygen (O) and other elements, which are unavoidably included in general steels, are contained as steel constituents, the effect of the present invention is not deteriorated at all.

Further, in the coated steel sheet according to the present invention, in addition to the above elements and unavoidable impurities, elements, which are generally incidentally present in steels, maybe contained as incidental constituents in such an amount that does not sacrifice the properties of the coated steel sheet.

The ductility of the steel sheet of the present invention as the final product varies depending upon the volume fraction of retained austenite contained in the product. The retained austenite contained in the metallurgical structure is stably present when the steel sheet does not undergo any deformation. Upon the application of deformation, however, the retained austenite is transformed to martensite to develop transformation induced plasticity. Therefore, in the steel sheet containing retained austenite in the metallurgical structure, good formability can be realized while enjoying high strength.

When the volume fraction of retained austenite is less than 2%, the above effect is not significantly attained. On the other hand, when the volume fraction of retained austenite exceeds 20%, there is a possibility that forming under extremely severe conditions provides a press formed product containing a large amount of marten site. As a result, problems associated with secondary formability and impact resistance sometimes occur. For the above reason, in the present invention, the volume fraction of retained austenite is limited to not more than 20%.

The ductility of the steel sheet of the present invention as the final product varies depending upon the volume fraction of retained austenite contained in the steel sheet as the final product. The retained austenite remaining in the metallurgical structure is stably present when the steel sheet does not undergo any deformation. Upon the application of deformation, however, the retained austenite is transformed to martensite to develop transformation induced plasticity. Therefore, good formability can be realized while enjoying high strength.

When the volume fraction of retained austenite is less than 2%, the effect of improving the formability is not significant. On the other hand, when the volume fraction of retained austenite exceeds 20%, there is a possibility that forming under extremely severe conditions provides a formed product containing a large amount of martensite. The presence of the martensite sometimes causes problems associated with secondary formability and impact resistance. For the above reason, in the present invention, the volume fraction of retained austenite is limited to not more than 20%.

(b) Zinc Coated Layer

In the steel sheet according to the present invention, a zinc coated layer is provided on the steel sheet substrate. The zinc coated layer according to the present invention may be either a galvanized layer or a galvannealed layer. The galvanized layer and the galvannealed layer will be described in detail.

The galvanized layer comprises zinc: not less than 80% and aluminum: not more than 1% with the balance consisting of zinc and unavoidable impurities. The reason why the content of zinc in the galvanized layer is limited to not less than 80% is that, when the zinc content is less than 80%, the coated layer is hard and is disadvantageously cracked at the time of forming. The reason why the content of aluminum in the galvanized layer is limited to not more than 1% is that, when the aluminum content exceeds 1%, aluminum segregated during coating constitutes a local battery which deteriorates corrosion resistance.

The galvannealed layer is useful particularly for improving spot weldability. The galvannealed layer comprises zinc: 80 to 91%, iron: 8 to 15%, and aluminum: not more than 1% with the balance consisting of zinc and unavoidable impurities. The reason why the content of zinc in the galvannealed layer is limited to not less than 80% is that, when the zinc content is less than 80%, the coated layer is hard and is disadvantageously cracked at the time of forming. The reason why the upper limit of the content of zinc in the galvannealed layer is 91% is that, when the zinc content exceeds 91%, the spot weldability is disadvantageously deteriorated making it impossible to attain the object of the present invention.

The reason why the content of iron in the galvannealed layer is limited to not less than 8% is that, when the iron content is less than 8%, the suitability for conversion treatment (phosphate treatment) and the plating adhesion cannot be ensured. The reason why the upper limit of the content of iron in the coating layer is 15% is that, when the iron content exceeds 15%, overalloying occurs and, consequently, plating adhesion in the worked part is deteriorated.

The reason why the content of aluminum in the galvannealed layer is limited to not more than 1% is that, when the aluminum content exceeds 1%, aluminum segregated during coating constitutes a local battery and, consequently, the corrosion resistance of the steel sheet is deteriorated.

The galvanized layer and the galvannealed layer in the steel sheet according to the present invention are as described above. In addition to the above constituents, elements such as manganese (Mn), lead (Pb), antimony (Sb), calcium (Ca), and magnesium (Mg) maybe contained as unavoidable impurities. Further, very small amounts of other elements may be contained as incidental constituents.

The thickness of the galvanized layer and the galvannealed layer is not particularly limited. Preferably, however, the thickness is not less than 0.1 $\mu$m from the viewpoint of ensuring corrosion resistance, and is not more than 15 $\mu$m from the viewpoint of ensuring workability.

Production Process

Next, the process for producing the hot-dip galvanized or galvannealed steel sheet according to the present invention will be described.

The hot-dip galvanized steel sheet according to the present invention is produced by annealing a cold rolled steel sheet having the above-described chemical composition for 10 sec to 6 min in the intercritical temperature range of 650 to 900° C., then cooling the annealed steel sheet to 350 to 500° C. at a cooling rate of 2 to 200° C./sec, optionally further holding the cooled steel sheet in said cooling temperature range for not more than 10 min, then subjecting the cooled steel sheet to hot-dip galvanizing, and then cooling the coated steel sheet to 250° C. or below at a cooling rate of not less than 5° C./sec.

The hot-dip galvannealed steel sheet according to the present invention is produced by annealing a cold rolled steel sheet having the above-described chemical composition for 10 sec to 6 min in the intercritical temperature range of 650 to 900° C., then cooling the annealed steel sheet to 350 to 500° C. at a cooling rate of 2 to 200° C./sec, optionally further holding the cooled steel sheet in said cooling temperature range for not more than 10 min, then subjecting the cooled steel sheet to hot-dip galvannealing process, holding the coated steel sheet in the temperature region of 450 to 600° C. for 5 sec to 2 min, and then cooling the coated steel sheet to 250° C. or below at a cooling rate of not less than 5° C./sec.

In continuous annealing of the cold rolled steel sheet after cold rolling, the cold rolled steel sheet is first heated to the temperature range of $Ac_1$ transformation point to $Ac_3$ transformation point to form a two-phase structure of [ferrite+austenite]. At that time, when the heating temperature is below 650° C., a lot of time is required for the redissolution of cementite to form a solid solution, and the existing amount of austenite is very small. For this reason, the lower limit of the heating temperature is 650° C.

On the other hand, when the heating temperature is excessively high, the volume fraction of austenite is so large that the content of carbon in austenite is lowered. For the above reason, the upper limit of the heating temperature is 900° C. When the holding time in this temperature range is excessively short, the possibility of presence of undissolved carbides is high and, consequently, the existing amount of austenite is small. On the other hand, when the holding time is long, grains become coarse and, as a result, the amount of austenite, which is finally present, is reduced, resulting in deteriorated strength-ductility balance. For the above reason, in the present invention, the holding time is limited to 10 sec to 6 min.

After the equation of heat, the steel sheet is cooled to 350 to 500° C. at a cooling rate of 2 to 200° C./sec. The object of this step is as follows. In this step, austenite formed by heating in the two-phase region is carried forward to a bainite transformation region without transformation to pearlite, and subsequent treatment permits retained austenite and bainite to exist at room temperature, whereby predetermined properties are provided. In this case, when the cooling rate is less than 2° C./sec, a major part of austenite disadvantageously causes pearlite transformation during cooling. As a result, retained austenite cannot be ensured. On the other hand, when the cooling rate exceeds 200° C./sec, the cooling termination temperature significantly deviates from a predetermined value in the widthwise direction and longitudinal direction. This makes it impossible to produce a steel sheet having homogeneous quality.

The termination temperature of cooling from the two-phase region is determined from the viewpoint of the suitability for hot-dip galvanizing. When the hot-dip galvanizing temperature is excessively low, the wettability of the steel sheet by coating is lowered and, consequently, plating adhesion is deteriorated. On the other hand, when the hot-dip galvanizing temperature is excessively high, an alloying reaction of iron with zinc proceeds in a zinc bath and, consequently, the concentration of iron in the coating is increased. For the above reason, in the present invention, the termination temperature of cooling from the two-phase region and the hot-dip zinc coating temperature are limited to 350 to 500° C.

Further, before hot-dip galvanizing, if necessary, the steel sheet is held in the temperature range of 350 to 500° C. for not more than 10 min. Holding the temperature of the steel sheet before hot-dip galvanizing allows bainite transformation to proceed, and carbon-enriched retained austenite can be stabilized. As a result, steel sheets having a combination of good strength with good elongation can be more stably produced.

When the termination temperature of cooling from the two-phase region exceeds 500° C., austenite is decomposed to carbides during subsequent temperature holding, and it is difficult for austenite to remain undecomposed. On the other hand, when the cooling termination temperature is below 350° C., a major part of austenite is transformed to martensite. As a result, the press formability is likely to be deteriorated, although the strength is enhanced. Further, in this case, at the time of galvanizing, the steel sheet temperature should be raised. This is ineffective from the viewpoint of thermal energy.

For the above reason, the holding temperature is limited to 350 to 500° C. When the temperature holding time exceeds 10 min, upon heating after zinc coating, the precipitation of carbides and the disappearance of untransformed austenite take place. As a result, both the strength and the press formability are likely to be deteriorated. For the above reason, when the temperature is held, the temperature holding time is limited to not more than 10 min.

In producing the hot-dip galvanized steel sheet, after hot-dip galvanizing process, the coated steel sheet is cooled to 250° C. or below at a cooling rate of not less than 5° C./sec. Here at the time of galvanizing, bainite transformation is allowed to proceed to develop a mixed structure. The mixed structure comprises bainite, which is substantially free from carbides, retained austenite, which has been enriched with carbon scavenged from that portion and has an Ms point lowered to room temperature or below, and ferrite, which has been further cleaned during heating in the two-phase region. This structure can simultaneously realize high strength and good formability.

In this case, when the cooling rate after temperature holding is less than 5° C./sec or when the cooling termination temperature is above 250° C., austenite, which has been enriched with carbon during cooling, also causes carbide precipitation and is decomposed to bainite. This disadvantageously reduces the amount of retained austenite which improves workability through transformation induced plasticity. As a result, the object of the present invention cannot be attained. In order to increase the amount of the retained austenite remaining untransformed, preferably, the holding temperature after hot-dip galvanizing process is 350 to 400° C., and the holding time is not more than 5 min.

Further, in producing the hot-dip galvannealed steel sheet, after hot-dip galvannealing process, the coated steel sheet is held in the temperature range of 450 to 600° C. for 5 sec to 2 min and is then cooled to 250° C. or below at a cooling rate of not less than 5° C./sec. The above conditions are determined from the viewpoints of the alloying reaction of iron with zinc and the optimization of the structure of the steel sheet.

In the steel according to the present invention, silicon and aluminum are contained, and through the utilization of two-stage transformation from austenite to bainite, a mixed structure is developed which is composed of bainite, retained austenite, and ferrite. This bainite is substantially free from carbides. The austenite has been enriched with carbon scavenged from that portion and has an Ms point lowered to room temperature or below. The ferrite has been further cleaned during heating in the two-phase region. The development of the mixed structure can simultaneously realize high strength and good formability. When the holding temperature is above 600° C., pearlite is formed and the retained austenite is not contained in the steel sheet. Further, in this case, the alloying reaction excessively proceeds. Consequently, the concentration of iron in the coating disadvantageously exceeds 12%.

On the other hand, when the heating temperature is 450° C. or below, the alloying reaction rate of the coating is lowered and, consequently, the concentration of iron in the coating is lowered.

When the holding time is not more than 5 sec, bainite is not satisfactorily formed and the enrichment of untransformed austenite with carbon is also unsatisfactory. In this case, during cooling, martensite is formed, resulting in deteriorated formability. At the same time, the galvannealing reaction is unsatisfactory.

On the other hand, when the holding time is not less than 2 min, overalloying of the coating occurs and, at the time of forming, coating separation or the like is disadvantageously likely to occur. When the cooling rate after the temperature holding is less than 5° C./sec or when the cooling termination temperature is above 250° C., bainite transformation further proceeds and austenite, which has been enriched with carbon in the preceding reaction, also causes carbide precipitation and is decomposed to bainite. This disadvantageously reduces the amount of retained austenite which improves workability through transformation induced plasticity. As a result, the object of the present invention cannot be attained.

The hot-dip galvanizing temperature is preferably between the melting point of the zinc bath and 500° C. When the hot-dip galvanizing temperature is above 500° C., a large amount of vapor is produced from the zinc bath and, consequently, the operating efficiency is deteriorated. The rate of heating to the holding temperature after the coating is not particularly limited. The heating rate, however, is preferably not less than 3° C./sec from the viewpoints of the coating structure and the metallurgical structure.

The temperature and the cooling temperature in the above-described individual steps are not necessarily constant so far as the temperature and the cooling temperature fall within the above-specified respective ranges. Even when the temperature or the cooling temperature fluctuates within the above-specified range, the properties of the final product are not deteriorated and, in some cases, are improved. The material used in the present invention may have been produced through refining, casting, hot rolling, and cold rolling steps in a conventional steelmaking process. Alternatively, the material used in the present invention may have been produced by a process wherein a part or the whole of these steps has been omitted. Conditions of these steps are also not particularly limited.

In order to further improve the plating adhesion, before annealing, the steel sheet may be coated with nickel, copper, cobalt, and iron, either alone or in combination. Another method usable for improving the plating adhesion is to properly regulate the atmosphere at the time of annealing of the steel sheet. For example, a method may be adopted wherein, before coating, the surface of the steel sheet is first oxidized in atmosphere and is then reduced to clean the surface of the steel sheet. Further, for plating adhesion improvement purposes, before annealing, pickling of the steel sheet or grinding of the steel sheet may be carried out to remove oxides on the surface of the steel sheet. This does not change the subject matter of the present invention. The above treatments can improve plating adhesion and further can accelerate alloying.

As described above, the present invention can efficiently produce high strength hot-dip galvanized or galvannealed steel sheets having good press formability and plating adhesion which can be used as automobile, building, electric or other members and other applications.

EXAMPLES

The following examples further illustrate but do not limit the present invention.

Example A1

Steels having chemical compositions shown in Table A1 were reheated to 1250° C., were then finish rolled at 900° C., and were coiled at 650° C. to prepare 4 mm-thick hot rolled steel sheets. Scale deposited on the surface of the hot rolled steel sheets was removed with hydrochloric acid, and the steel sheets were then cold rolled to prepare 1.4 mm-thick cold rolled steel sheets. The cold rolled steel sheets were annealed under conditions shown in Table A2 and Table A3 (continuation from Table A2), were coated, and were then temper rolled with a reduction of 0.5%. The steel sheets thus obtained were subjected to the following performance evaluation tests, that is, "tensile test," "retained austenite measuring test," "welding test," "appearance of coating," "plating adhesion," and "measurement of concentration in coated layer." In the coating in the above production of the steel sheets, both sides of the cold rolled steel sheets were coated at a coverage of coating of 50 g/m$^2$ per side.

In the "tensile test," a JIS No. 5 tensile test piece was extracted in C-direction, and a cold tensile test was carried out under conditions of gauge thickness 50 mm and tensile speed 10 mm/min.

The "retained austenite measuring test" was carried out by a method called "5-peak" method. In this method, a quarter of the sheet thickness from the surface toward the inner side of the sheet was chemically polished, α-iron intensity and γ-iron intensity were then measured by X-ray diffractometry using an Mo bulb, and the volume fraction of retained austenite was determined based on the α-iron intensity and the γ-iron intensity.

The "welding test" was carried out by performing spot welding under welding conditions of welding current: 10 kA, applied pressure: 220 kg, welding time: 12 cycles, electrode diameter: 6 mm, electrode shape: domed, and tip: 6ϕ-40R, and counting the number of continuous spots provided until the welding reached the point at which the nugget diameter became below $4\sqrt{t}$ wherein t represents sheet thickness. The counted number of continuous spots was evaluated according to the following criteria. ○: more than 1,000 continuous spots, Δ: 500 to 1,000 continuous spots, and ×: less than 500 continuous spots. Here ○ was regarded as acceptable, and Δ and × as unacceptable.

The "appearance of coating" was determined by visually inspecting the appearance of the coated steel sheet for noncoated sites and evaluating the results according to the following criteria. ○: not more than 5/dm$^2$, Δ: 6 to 15/dm$^2$, and ×: not less than 16/dm$^2$. Here ○ was regarded as acceptable, and Δ and × as unacceptable.

The "plating adhesion" was determined by subjecting the coated steel sheet to a 60-degree V bending test, then performing a tape test, and evaluating the results according to the following criteria.

Blackening in tape test (%)

◎: 0 to 10

○: 10 to less than 20

Δ: 20 to less than 30

×: not less than 30

(◎ and ○: acceptable, Δ and ×: unacceptable)

The "measurement of concentration in coated layer" was carried out by dissolving the coated layer in 5% hydrochloric acid containing an amine-based inhibitor and then analyzing the solution by ICP emission spectroscopy.

The results of the above performance evaluation tests are shown in Table A4 and Table A5 (continuation from Table A4). For all of samples 1 to 13 which are examples of the present invention, the total elongation was not less than 30% while ensuring a tensile strength of not less than 550 MPa, indicating that high strength and good press formability could be simultaneously realized. At the same time, for these samples, the plating adhesion was acceptable.

By contrast, samples 14 to 23, which are comparative examples, could not attain the object of the present invention, because, for sample 14, the content of carbon was lower than the carbon content range specified in the present invention; for sample 15, the content of carbon was higher than the carbon content range specified in the present invention; for sample 16, the content of silicon was lower than the silicon content range specified in the present invention; for sample 17, the content of silicon was higher than the silicon content range specified in the present invention; samples 18 and 19 failed to satisfy the relationship between silicon and aluminum specified in the present invention; for sample 20, the content of manganese was lower than the manganese content range specified in the present invention; for sample 21, the content of manganese was higher than the manganese content range specified in the present invention; for sample 22, the content of aluminum was higher than the aluminum content range specified in the present invention; and, for sample 23, the content of tin was lower than the tin content range specified in the present invention.

For samples 24 to 48 as comparative examples, although the chemical compositions of the steels fell within the scope of the present invention, any one of the treatment conditions was outside the scope of the present invention. These comparative samples suffered from poor strength-ductility balance or poor plating adhesion and thus could not attain the object of the present invention.

TABLE A1

| | Chemical composition, weight % | | | | | | | | | | | | |
|---|---|---|---|---|---|---|---|---|---|---|---|---|---|
| Steel | C | Si | Mn | P | S | Al | Sn | Ni | Cu | Co | Others | Si + 0.8 Al | Remarks |
| a | 0.08 | 1.21 | 1.55 | 0.004 | 0.005 | 0.25 | 0.056 | 0.02 | 0.01 | — | — | 1.41 | Ex. of inv. |
| b | 0.12 | 0.24 | 2.21 | 0.014 | 0.003 | 0.73 | 0.015 | 0.05 | 0.04 | 0.02 | Mo: 0.11, Ca: 0.02 | 0.824 | Ex. of inv. |
| c | 0.16 | 1.30 | 1.40 | 0.008 | 0.004 | 0.02 | 0.720 | 0.03 | 0.20 | — | Cr: 0.22 | 1.316 | Ex. of inv. |
| d | 0.13 | 0.65 | 1.00 | 0.009 | 0.006 | 0.74 | 0.132 | 0.87 | 1.30 | — | Sb: 0.12 | 1.242 | Ex. of inv. |
| e | 0.04 | 1.30 | 2.40 | 0.015 | 0.002 | 0.21 | 0.082 | 0.06 | 0.02 | — | Ce (REM): 0.002, Nb: 0.03 | 1.468 | Ex. of inv. |
| f | 0.07 | 0.34 | 0.90 | 0.012 | 0.012 | 0.65 | 0.008 | 1.60 | 0.20 | 0.23 | Ti: 0.02, Zr: 0.05 | 0.86 | Ex. of inv. |
| g | 0.17 | 1.70 | 1.50 | 0.005 | 0.008 | 0.23 | 0.432 | 0.20 | 0.10 | — | Mg: 0.003 | 1.884 | Ex. of inv. |
| h | 0.09 | 0.82 | 1.40 | 0.005 | 0.004 | 0.34 | 0.187 | 0.67 | 0.92 | — | — | 1.092 | Ex. of inv. |
| i | 0.11 | 0.46 | 1.60 | 0.012 | 0.011 | 0.95 | 0.861 | 0.11 | 0.02 | — | Y (REM): 0.07, Ca: 0.01 | 1.22 | Ex. of inv. |
| j | 0.07 | 1.12 | 1.30 | 0.004 | 0.005 | 0.02 | 0.006 | 1.12 | 0.65 | 0.01 | — | 1.136 | Ex. of inv. |
| k | 0.18 | 0.93 | 1.6 | 0.008 | 0.009 | 0.14 | 0.229 | 0.23 | 0.06 | 0.01 | Mo: 0.04, Ti: 0.01, Mg: 0.02 | 1.042 | Ex. of inv. |
| l | 0.08 | 0.82 | 1.70 | 0.004 | 0.005 | 0.13 | 0.046 | 0.02 | 0.01 | 0.02 | — | 0.924 | Ex. of inv. |
| m | 0.17 | 1.40 | 1.70 | 0.005 | 0.008 | 0.23 | 0.079 | 0.20 | 0.10 | — | Mg: 0.02 | 1.584 | Ex. of inv. |
| n | 0.01 | 0.34 | 1.03 | 0.003 | 0.005 | 0.55 | 0.028 | 0.01 | 0.03 | — | — | 0.78 | Comp. Ex. |
| o | 0.22 | 0.62 | 1.82 | 0.013 | 0.002 | 0.22 | 0.102 | 0.02 | 0.02 | — | Bi: 0.05 | 0.796 | Comp. Ex. |
| p | 0.13 | 0.13 | 1.34 | 0.007 | 0.003 | 0.39 | 0.043 | 0.02 | 0.02 | 0.12 | Ce (REM): 0.2 | 0.442 | Comp. Ex. |
| q | 0.16 | 1.92 | 0.97 | 0.008 | 0.002 | 0.24 | 0.081 | 1.20 | 0.10 | — | — | 2.112 | Comp. Ex. |
| r | 0.15 | *0.22 | 0.58 | 0.004 | 0.007 | *0.12 | 0.210 | 0.02 | 0.23 | 0.04 | V: 0.01, Zr: 0.02 | 0.316 | Comp. Ex. |
| s | 0.12 | *1.55 | 1.52 | 0.005 | 0.003 | *0.73 | 0.192 | 0.08 | 0.13 | — | — | 2.134 | Comp. Ex. |
| t | 0.06 | 0.36 | 0.18 | 0.008 | 0.003 | 0.22 | 0.062 | 0.66 | 0.22 | — | Sb: 0.22, Ca: 0.21 | 0.536 | Comp. Ex. |
| u | 0.14 | 0.73 | 2.65 | 0.009 | 0.005 | 0.54 | 0.009 | 0.23 | 0.15 | — | Cr: 0.23, Mo: 0.09 | 1.162 | Comp. Ex. |
| v | 0.12 | 0.54 | 0.85 | 0.005 | 0.006 | 1.63 | 0.008 | 0.01 | 1.10 | 0.12 | — | 1.844 | Comp. Ex. |
| w | 0.09 | 0.62 | 1.22 | 0.012 | 0.002 | 0.32 | 0.001 | 0.32 | 0.03 | — | Ti: 0.03, Nb: 0.03 | 0.876 | Comp. Ex. |

Note)
Mark __ indicates that the value is outside the scope of the present invention.
Mark * indicates that the value does not satisfy the relationship between Al and Si specified in the present invention.
Mark — indicates that the constituent is not contained.

TABLE A2

| Sample | Steel | Annealing temp., ° C. | Annealing time, sec | Cooling rate, ° C./sec | Cooling termination temp., ° C. | Holding temp. before coating, ° C. | Holding time, sec | Coating temp., ° C. | Al content of zinc bath, % | Alloying temp., ° C. | Alloying time, sec | Cooling rate, ° C./sec | Cooling temp., ° C. | Remarks |
|---|---|---|---|---|---|---|---|---|---|---|---|---|---|---|
| 1 | a | 800 | 150 | 10 | 400 | 400–450 | 60 | 450 | 0.11 | 500 | 25 | 10 | 180 | GA |
| 2 | b | 750 | 90 | 20 | 400 | — | — | 450 | 0.14 | 520 | 30 | 15 | 150 | GA |
| 3 | c | 800 | 100 | 40 | 420 | 360–400 | 420 | 470 | 0.16 | — | — | 10 | 180 | GI |
| 4 | d | 750 | 90 | 150 | 380 | — | — | 450 | 0.10 | 500 | 25 | 10 | 180 | GA |
| 5 | e | 780 | 150 | 3 | 370 | 350–380 | 300 | 440 | 0.12 | — | — | 10 | 180 | GI |
| 6 | f | 800 | 90 | 20 | 480 | — | — | 450 | 0.15 | — | — | 10 | 180 | GI |
| 7 | g | 750 | 200 | 20 | 410 | — | — | 450 | 0.15 | 500 | 30 | 10 | 180 | GA |
| 8 | h | 850 | 85 | 7 | 440 | 400–470 | 40 | 450 | 0.20 | 500 | 25 | 10 | 180 | GA |
| 9 | i | 750 | 150 | 10 | 360 | 360–440 | 200 | 450 | 0.11 | — | — | 10 | 180 | GI |
| 10 | j | 800 | 90 | 20 | 480 | 400–500 | 100 | 450 | 0.15 | 500 | 25 | 10 | 180 | GA |
| 11 | k | 750 | 110 | 5 | 440 | — | — | 450 | 0.20 | 500 | 30 | 10 | 180 | GA |
| 12 | l | 700 | 120 | 10 | 400 | 360–440 | 60 | 450 | 0.18 | 550 | 10 | 10 | 180 | GA |
| 13 | m | 800 | 200 | 15 | 430 | — | — | 460 | 0.20 | — | — | 10 | 200 | GI |
| 14 | n | 830 | 90 | 20 | 410 | 400–470 | 30 | 450 | 0.15 | — | — | 10 | 180 | GI |
| 15 | o | 800 | 120 | 6 | 420 | — | — | 460 | 0.14 | 520 | 15 | 10 | 180 | GA |
| 16 | p | 750 | 110 | 10 | 370 | — | — | 450 | 0.10 | 500 | 25 | 10 | 180 | GA |
| 17 | q | 820 | 90 | 20 | 480 | 430–500 | 30 | 450 | 0.09 | 580 | 30 | 10 | 180 | GA |
| 18 | r | 750 | 90 | 20 | 410 | — | — | 450 | 0.16 | 500 | 20 | 10 | 180 | GA |
| 19 | s | 870 | 150 | 9 | 440 | 370–440 | 300 | 450 | 0.13 | 500 | 25 | 10 | 180 | GA |

TABLE A2-continued

| Sample | Steel | Annealing temp., ° C. | Annealing time, sec | Cooling rate, ° C./sec | Cooling termination temp., ° C. | Holding temp. before coating, ° C. | Holding time, sec | Coating temp., ° C. | Al content of zinc bath, % | Alloying temp., ° C. | Alloying time, sec | Cooling rate, ° C./sec | Cooling temp., ° C. | Remarks |
|---|---|---|---|---|---|---|---|---|---|---|---|---|---|---|
| 20 | t | 750 | 70 | 20 | 420 | — | — | 450 | 0.18 | 500 | 25 | 10 | 180 | GA |
| 21 | u | 830 | 90 | 10 | 480 | 400–490 | 30 | 450 | 0.17 | 500 | 25 | 10 | 180 | GA |
| 22 | v | 750 | 200 | 20 | 490 | 400–470 | 80 | 450 | 0.09 | — | — | 10 | 180 | GI |
| 23 | w | 800 | 120 | 5 | 400 | — | — | 440 | 0.14 | — | — | 10 | 180 | GI |
| 24 | a | 600 | 90 | 20 | 360 | — | — | 470 | 0.08 | 500 | 30 | 10 | 180 | GA |

Note)
Mark ____ indicates that the value is outside the scope of the present invention. The heating rate after coating was constant and 10° C./sec.
GA represents a hot-dip galvannealed steel sheet.
GI represents a hot-dip galvanized steel sheet.

TABLE A3

(continuation from TABLE A2)

| Sample | Steel | Annealing temp., ° C. | Annealing time, sec | Cooling rate, ° C./sec | Cooling termination temp., ° C. | Holding temp. before coating, ° C. | Holding time, sec | Coating temp., ° C. | Al content of zinc bath, % | Alloying temp., ° C. | Alloying time, sec | Cooling rate, ° C./sec | Cooling temp., ° C. | Remarks |
|---|---|---|---|---|---|---|---|---|---|---|---|---|---|---|
| 25 | a | 950 | 90 | 80 | 480 | 400–500 | 60 | 450 | 0.11 | 480 | 50 | 10 | 180 | GA |
| 26 | a | 750 | 5 | 20 | 440 | 430–500 | 20 | 450 | 0.20 | 500 | 30 | 10 | 180 | GA |
| 27 | a | 800 | 400 | 20 | 410 | — | — | 480 | 0.17 | 500 | 40 | 20 | 220 | GA |
| 28 | a | 750 | 90 | 1 | 370 | 430–500 | 30 | 450 | 0.13 | 510 | 30 | 10 | 180 | GA |
| 29 | a | 800 | 110 | 10 | 300 | 370–440 | 300 | 450 | 0.09 | 480 | 50 | 10 | 180 | GA |
| 30 | a | 770 | 90 | 70 | 520 | 370–440 | 300 | 450 | 0.14 | 500 | 30 | 10 | 180 | GA |
| 31 | a | 830 | 150 | 10 | 420 | 400–490 | 650 | 480 | 0.18 | 500 | 30 | 10 | 180 | GA |
| 32 | a | 800 | 70 | 20 | 410 | 400–470 | 80 | 430 | 0.11 | 430 | 40 | 15 | 180 | GA |
| 33 | a | 750 | 90 | 25 | 440 | 370–440 | 140 | 480 | 0.16 | 620 | 20 | 10 | 100 | GA |
| 34 | a | 850 | 60 | 20 | 420 | — | — | 450 | 0.20 | 500 | 3 | 8 | 180 | GA |
| 35 | a | 750 | 90 | 80 | 480 | — | — | 450 | 0.12 | 500 | 130 | 10 | 180 | GA |
| 36 | a | 820 | 70 | 50 | 490 | 400–470 | 250 | 440 | 0.10 | 500 | 25 | 3 | 180 | GA |
| 37 | a | 750 | 100 | 20 | 360 | — | — | 450 | 0.08 | 500 | 30 | 10 | 300 | GA |
| 38 | a | 830 | 90 | 20 | 480 | 400–500 | 60 | 450 | 0.82 | 500 | 25 | 10 | 180 | GA |
| 39 | a | 600 | 90 | 20 | 360 | — | — | 470 | 0.08 | — | — | 10 | 180 | GI |
| 40 | a | 950 | 90 | 80 | 480 | 400–500 | 60 | 450 | 0.11 | — | — | 10 | 180 | GI |
| 41 | a | 750 | 5 | 20 | 440 | 430–500 | 20 | 450 | 0.20 | — | — | 10 | 180 | GI |
| 42 | a | 800 | 420 | 20 | 410 | — | — | 480 | 0.17 | — | — | 20 | 220 | GI |
| 43 | a | 750 | 90 | 1 | 370 | 430–500 | 30 | 450 | 0.13 | — | — | 10 | 180 | GI |
| 44 | a | 800 | 110 | 10 | 300 | 370–440 | 300 | 450 | 0.09 | — | — | 10 | 180 | GI |
| 45 | a | 830 | 150 | 10 | 420 | 400–490 | 720 | 480 | 0.18 | — | — | 10 | 180 | GI |
| 46 | a | 820 | 70 | 50 | 490 | 400–470 | 250 | 440 | 0.10 | — | — | 3 | 180 | GI |
| 47 | a | 750 | 100 | 20 | 360 | — | — | 450 | 0.08 | — | — | 10 | 300 | GI |
| 48 | a | 830 | 90 | 20 | 480 | 400–500 | 60 | 450 | 0.82 | — | — | 10 | 180 | GI |

Note)
Mark ____ indicates that the value is outside the scope of the present invention. The heating rate after coating was constant and 10° C./sec.
GA represents a hot-dip galvannealed steel sheet.
GI represents a hot-dip galvanized steel sheet.

TABLE A4

| Sample | TS, MPa | El, % | Retained γ, % | Fe content of coating, % | Al content of coating, % | Appearance of coating | Plating adhesion | Weldability | Remarks |
|---|---|---|---|---|---|---|---|---|---|
| 1 | 630 | 36 | 8 | 10 | 0.22 | ○ | ◎ | ○ | Ex. of inv. |
| 2 | 660 | 34 | 10 | 10 | 0.18 | ○ | ◎ | ○ | Ex. of inv. |
| 3 | 720 | 34 | 13 | — | 0.28 | ○ | ◎ | ○ | Ex. of inv. |
| 4 | 640 | 31 | 11 | 11 | 0.16 | ○ | ◎ | ○ | Ex. of inv. |
| 5 | 780 | 30 | 3 | — | 0.18 | ○ | ◎ | ○ | Ex. of inv. |
| 6 | 580 | 36 | 9 | 10 | 0.82 | ○ | ◎ | ○ | Ex. of inv. |
| 7 | 840 | 31 | 15 | 10 | 0.13 | ○ | ○ | ○ | Ex. of inv. |
| 8 | 640 | 36 | 8 | 12 | 0.16 | ○ | ◎ | ○ | Ex. of inv. |
| 9 | 630 | 35 | 10 | — | 0.25 | ○ | ◎ | ○ | Ex. of inv. |
| 10 | 620 | 36 | 7 | 10 | 0.17 | ○ | ◎ | ○ | Ex. of inv. |
| 11 | 810 | 31 | 18 | 10 | 0.23 | ○ | ◎ | ○ | Ex. of inv. |
| 12 | 610 | 35 | 4 | 11 | 0.32 | ○ | ◎ | ○ | Ex. of inv. |
| 13 | 830 | 32 | 15 | — | 0.18 | ○ | ○ | ○ | Ex. of inv. |
| 14 | 540 | 28 | 1 | — | 0.20 | ○ | ◎ | ○ | Comp. Ex. |
| 15 | 810 | 25 | 22 | 10 | 0.21 | ○ | ◎ | X | Comp. Ex. |
| 16 | 570 | 28 | 1 | 10 | 0.16 | ○ | ◎ | ○ | Comp. Ex. |

TABLE A4-continued

| Sample | TS, MPa | El, % | Retained γ, % | Fe content of coating, % | Al content of coating, % | Appearance of coating | Plating adhesion | Weldability | Remarks |
|---|---|---|---|---|---|---|---|---|---|
| 17 | 710 | 30 | 8 | 6 | 0.32 | X | X | ○ | Comp. Ex. |
| 18 | 550 | 29 | 1 | 10 | 0.13 | ○ | ⊙ | ○ | Comp. Ex. |
| 19 | 620 | 33 | 6 | 10 | 0.19 | X | X | ○ | Comp. Ex. |
| 20 | 560 | 20 | 1 | 9 | 0.23 | ○ | ⊙ | ○ | Comp. Ex. |
| 21 | 700 | 34 | 7 | 10 | 0.28 | Δ | Δ | X | Comp. Ex. |
| 22 | 640 | 33 | 6 | — | 0.32 | X | X | ○ | Comp. Ex. |
| 23 | 660 | 33 | 5 | — | 0.28 | X | X | ○ | Comp. Ex. |
| 24 | 550 | 24 | 1 | 10 | 0.41 | ○ | ⊙ | ○ | Comp. Ex. |

Note)
Mark ____ indicates that the value is outside the scope of the present invention.

TABLE A5

(continuation from TABLE A4)

| Sample | TS, MPa | El, % | Retained γ, % | Fe content of coating, % | Al content of coating, % | Appearance of coating | Plating adhesion | Weldability | Remarks |
|---|---|---|---|---|---|---|---|---|---|
| 25 | 600 | 26 | 1 | 10 | 0.21 | ○ | ⊙ | ○ | Comp. Ex. |
| 26 | 620 | 20 | 1 | 9 | 0.23 | ○ | ⊙ | ○ | Comp. Ex. |
| 27 | 580 | 22 | 1 | 10 | 0.63 | ○ | ⊙ | ○ | Comp. Ex. |
| 28 | 550 | 26 | 1 | 10 | 0.27 | ○ | ⊙ | ○ | Comp. Ex. |
| 29 | 650 | 24 | 1 | 11 | 0.34 | ○ | ⊙ | ○ | Comp. Ex. |
| 30 | 610 | 34 | 6 | 15 | 0.28 | ○ | Δ | ○ | Comp. Ex. |
| 27 | 580 | 22 | 1 | 10 | 0.63 | ○ | ⊙ | ○ | Comp. Ex. |
| 31 | 600 | 29 | 1 | 10 | 0.41 | ○ | ⊙ | ○ | Comp. Ex. |
| 32 | 610 | 35 | 5 | 5 | 0.23 | ○ | ⊙ | ○ | Comp. Ex. |
| 27 | 580 | 22 | 1 | 10 | 0.63 | ○ | ⊙ | ○ | Comp. Ex. |
| 33 | 570 | 29 | 1 | 15 | 0.23 | ○ | Δ | ○ | Comp. Ex. |
| 34 | 630 | 35 | 6 | 7 | 0.23 | ○ | ⊙ | ○ | Comp. Ex. |
| 35 | 580 | 28 | 1 | 15 | 0.32 | ○ | Δ | ○ | Comp. Ex. |
| 36 | 580 | 26 | 1 | 10 | 0.23 | ○ | ⊙ | ○ | Comp. Ex. |
| 37 | 560 | 23 | 1 | 10 | 0.32 | ○ | ⊙ | ○ | Comp. Ex. |
| 38 | 630 | 35 | 7 | 10 | 1.23 | ○ | ⊙ | ○ | Comp. Ex. |
| 39 | 550 | 24 | 1 | 10 | 0.41 | ○ | ⊙ | ○ | Comp. Ex. |
| 40 | 600 | 26 | 1 | 10 | 0.21 | ○ | ⊙ | ○ | Comp. Ex. |
| 41 | 620 | 20 | 1 | 9 | 0.23 | ○ | ⊙ | ○ | Comp. Ex. |
| 42 | 580 | 22 | 1 | 10 | 0.63 | ○ | ⊙ | ○ | Comp. Ex. |
| 43 | 550 | 26 | 1 | 10 | 0.27 | ○ | ⊙ | ○ | Comp. Ex. |
| 44 | 650 | 24 | 1 | 11 | 0.34 | ○ | ⊙ | ○ | Comp. Ex. |
| 45 | 600 | 29 | 1 | 10 | 0.41 | ○ | ⊙ | ○ | Comp. Ex. |
| 46 | 580 | 26 | 1 | 10 | 0.23 | ○ | ⊙ | ○ | Comp. Ex. |
| 47 | 560 | 23 | 1 | 10 | 0.32 | ○ | ⊙ | ○ | Comp. Ex. |
| 48 | 630 | 35 | 7 | 10 | 1.23 | ○ | ⊙ | ○ | Comp. Ex. |

Note)
Mark ____ indicates that the value is outside the scope of the present invention.

Example B1

Steels having chemical compositions shown in Table B1 and Table B2 (continuation from Table B1) were reheated to 1250° C., were then finish rolled at 900° C., and were coiled at 650° C. to prepare 4 mm-thick hot rolled steel sheets. Scale deposited on the surface of the hot rolled steel sheets was removed with hydrochloric acid, and the steel sheets were then cold rolled to prepare 1.4 mm-thick cold rolled steel sheets. The cold rolled steel sheets were annealed under conditions shown in Table B3 and Table B4 (continuation from Table B3), were coated, and were then temper rolled with a reduction of 0.5%. The steel sheets thus obtained were subjected to the following performance evaluation tests, that is, "tensile test," "retained austenite measuring test," "welding test," "appearance of coating," "plating adhesion," and "measurement of concentration in coated layer." In the coating in the above production of the steel sheets, both sides of the cold rolled steel sheets were coated at a coverage of coating of 50 g/m$^2$ per side.

In the "tensile test," a JIS No. 5 tensile test piece was extracted in C-direction, and a cold tensile test was carried out under conditions of gauge thickness 50 mm and tensile speed 10 mm/min.

The "retained austenite measuring test" was carried out by a method called "5-peak" method. In this method, a quarter of the sheet thickness from the surface toward the inner side of the sheet was chemically polished, (α-iron intensity and γ-iron intensity were then measured by X-ray diffractometry using an Mo bulb, and the volume fraction of retained austenite was determined based on the (α-iron intensity and the γ-iron intensity.

The "welding test" was carried out by performing spot welding under welding conditions of welding current: 10 kA, applied pressure: 220 kg, welding time: 12 cycles, electrode diameter: 6 mm, electrode shape: domed, and tip: 6ϕ-40R, and counting the number of continuous spots provided until the welding reached the point at which the nugget diameter became below $4\sqrt{t}$ wherein t represents sheet thickness. The counted number of continuous spots was evaluated according to the following criteria. ⊙: more than 2,000 continuous spots, ○: more than 1,000 continuous spots, Δ: 500 to 1,000 continuous spots, and ×: less than 500 continuous spots. Here ◎ and ○ were regarded as acceptable, and Δ and × as unacceptable.

The "appearance of coating" was determined by visually inspecting the appearance of the coated steel sheet for non-coated sites and evaluating the results according to the following criteria.

○: not more than 5/dm$^2$, Δ: 6 to 15/dm$^2$, and ×: not less than 16/dm$^2$.

Here ○ was regarded as acceptable, and Δ and × as unacceptable.

The "plating adhesion" was determined by subjecting the coated steel sheet to a 60-degree V bending test, then performing a tape test, and evaluating the results according to the following criteria.

Blackening in tape test (%)

◎: 0 to 10

○: 10 to less than 20

Δ: 20 to less than 30

×: not less than 30

(◎ and ○: acceptable, Δ and ×: unacceptable)

The "measurement of concentration in coated layer" was carried out by dissolving the coated layer in 5% hydrochloric acid containing an amine-based inhibitor and then analyzing the solution by ICP emission spectroscopy.

The results of the above performance evaluation tests are shown in Table B5 and Table B6 (continuation from Table B5). For all of samples 1 to 13 which are examples of the present invention, the total elongation was not less than 30% while ensuring a tensile strength of not less than 550 MPa, indicating that high strength and good press formability could be simultaneously realized. At the same time, for these samples, the plating adhesion was acceptable.

By contrast, samples 14 to 26, which are comparative examples, could not attain the object of the present invention due to poor strength-ductility balance or poor plating adhesion, because, for sample 14, the content of carbon (C) was lower than the carbon (C) content range specified in the present invention; for sample 15, the content of carbon (C) was higher than the carbon (C) content range specified in the present invention; for sample 16, the content of silicon (Si) was lower than the silicon (Si) content range specified in the present invention; for sample 17, the content of silicon (Si) was higher than the silicon (Si) content range specified in the present invention; samples 18 and 19 failed to satisfy the relationship between silicon (Si) and aluminum (Al) specified in the present invention; for sample 20, the content of manganese (Mn) was lower than the manganese (Mn) content range specified in the present invention; for sample 21, the content of manganese (Mn) was higher than the manganese (Mn) content range specified in the present invention; for sample 22, the content of aluminum (Al) was higher than the aluminum (Al) content range specified in the present invention; for samples 23, 24, and 25, the content of selenium (Se)+bismuth (Bi)+antimony (Sb) was lower than the selenium+bismuth+antimony content range specified in the present invention; and, for sample 26, the content of selenium (Se)+bismuth (Bi)+antimony (Sb) was higher than the selenium+bismuth+antimony content range specified in the present invention.

For samples 27 to 51 (see Table B6) as comparative examples, although the chemical compositions of the steel sheets fell within the scope of the present invention, any one of the treatment conditions was outside the scope of the present invention. These comparative samples suffered from poor strength-ductility balance or poor plating adhesion and thus could not attain the object of the present invention.

TABLE B1

| | Chemical composition, weight % | | | | | | | | | | | | |
|---|---|---|---|---|---|---|---|---|---|---|---|---|---|
| Steel | C | Si | Mn | P | S | Al | Sb | Bi | Se | Sb + Bi + Se | Others | Si + 0.8 Al | Remarks |
| a | 0.08 | 1.21 | 1.55 | 0.004 | 0.005 | 0.25 | 0.056 | 0 | 0 | 0.056 | — | 1.41 | Ex. of inv. |
| b | 0.12 | 0.24 | 2.21 | 0.014 | 0.003 | 0.73 | 0 | 0.050 | 0 | 0.050 | Mo: 0.11, Ca: 0.02 | 0.824 | Ex. of inv. |
| c | 0.16 | 1.30 | 1.40 | 0.008 | 0.004 | 0.02 | 0 | 0 | 0.022 | 0.022 | Sn: 0.05, Cr: 0.22 | 1.316 | Ex. of inv. |
| d | 0.13 | 0.65 | 1.00 | 0.009 | 0.006 | 0.74 | 0.132 | 0.230 | 0.120 | 0.482 | Ni: 0.12 | 1.242 | Ex. of inv. |
| e | 0.04 | 1.30 | 2.40 | 0.015 | 0.002 | 0.21 | 0.082 | 0.060 | 0.020 | 0.162 | Ce (REM): 0.002, Nb: 0.03 | 1.468 | Ex. of inv. |
| f | 0.07 | 0.34 | 0.90 | 0.012 | 0.012 | 0.65 | 0.008 | 0.002 | 0.001 | 0.011 | Ti: 0.02, Zr: 0.05 | 0.86 | Ex. of inv. |
| g | 0.17 | 1.70 | 1.50 | 0.005 | 0.008 | 0.23 | 0.112 | 0.200 | 0.100 | 0.412 | Mg: 0.003 | 1.884 | Ex. of inv. |
| h | 0.09 | 0.82 | 1.40 | 0.005 | 0.004 | 0.34 | 0.187 | 0 | 0.030 | 0.217 | — | 1.092 | Ex. of inv. |
| i | 0.11 | 0.46 | 1.60 | 0.012 | 0.011 | 0.95 | 0.742 | 0.110 | 0.020 | 0.872 | Y (REM): 0.07, Ca: 0.01 | 1.22 | Ex. of inv. |
| j | 0.07 | 1.12 | 1.30 | 0.004 | 0.005 | 0.02 | 0.006 | 0.320 | 0 | 0.326 | — | 1.136 | Ex. of inv. |
| k | 0.18 | 0.93 | 1.6 | 0.008 | 0.009 | 0.14 | 0.229 | 0.230 | 0.060 | 0.519 | Mo: 0.04, Ti: 0.01, Mg: 0.02 | 1.042 | Ex. of inv. |
| l | 0.08 | 0.82 | 1.70 | 0.004 | 0.005 | 0.13 | 0.046 | 0.020 | 0.010 | 0.076 | — | 0.924 | Ex. of inv. |
| m | 0.17 | 1.40 | 1.70 | 0.005 | 0.008 | 0.23 | 0 | 0.200 | 0.100 | 0.300 | Mg: 0.02, Co: 0.05 | 1.584 | Ex. of inv. |

Note)
In the table, mark ____ indicates that the value is outside the scope of the present invention;
mark * indicates that the value does not satisfy the relationship between Al and Si specified in the present invention; and
mark — indicates that the constituent is not contained.

TABLE B2

(continuation from TABLE B1)

| | Chemical composition, weight % | | | | | | | | | | | | |
|---|---|---|---|---|---|---|---|---|---|---|---|---|---|
| Steel | C | Si | Mn | P | S | Al | Sb | Bi | Se | Sb + Bi + Se | Others | Si + 0.8 Al | Remarks |
| n | 0.01 | 0.34 | 1.03 | 0.003 | 0.005 | 0.55 | 0.028 | 0.010 | 0.030 | 0.068 | — | 0.78 | Comp. Ex. |
| o | 0.22 | 0.62 | 1.82 | 0.013 | 0.002 | 0.22 | 0.102 | 0.020 | 0.020 | 0.142 | Sn: 0.05 | 0.796 | Comp. Ex. |

TABLE B2-continued (continuation from TABLE B1)

| Steel | Chemical composition, weight % | | | | | | | | | | | | |
|---|---|---|---|---|---|---|---|---|---|---|---|---|---|
| | C | Si | Mn | P | S | Al | Sb | Bi | Se | Sb + Bi + Se | Others | Si + 0.8 Al | Remarks |
| p | 0.13 | 0.13 | 1.34 | 0.007 | 0.003 | 0.39 | 0.043 | 0.020 | 0 | 0.063 | Ce (REM): 0.2 | 0.442 | Comp. Ex. |
| q | 0.16 | 1.92 | 0.97 | 0.008 | 0.002 | 0.24 | 0.004 | 0.002 | 0.002 | 0.008 | — | 2.112 | Comp. Ex. |
| r | 0.15 | *0.22 | 0.58 | 0.004 | 0.007 | *0.12 | 0.210 | 0.020 | 0.230 | 0.460 | V: 0.01, Zr: 0.02 | 0.316 | Comp. Ex. |
| s | 0.12 | *1.55 | 1.52 | 0.005 | 0.003 | *0.73 | 0.192 | 0.080 | 0.130 | 0.402 | — | 2.134 | Comp. Ex. |
| t | 0.06 | 0.36 | 0.18 | 0.008 | 0.003 | 0.22 | 0.062 | 0.042 | 0.220 | 0.324 | Cu: 0.22, Ca: 0.21 | 0.536 | Comp. Ex. |
| u | 0.14 | 0.73 | 2.65 | 0.009 | 0.005 | 0.54 | 0 | 0.230 | 0.150 | 0.380 | Cr: 0.23, Mo: 0.09 | 1.162 | Comp. Ex. |
| v | 0.12 | 0.54 | 0.85 | 0.005 | 0.006 | 1.63 | 0.008 | 0.010 | 0.023 | 0.041 | — | 1.844 | Comp. Ex. |
| w | 0.09 | 0.62 | 1.22 | 0.012 | 0.002 | 0.32 | 0.001 | 0 | 0 | 0.001 | Ti: 0.03, Nb: 0.03 | 0.876 | Comp. Ex. |
| x | 0.09 | 0.62 | 1.22 | 0.012 | 0.002 | 0.32 | 0 | 0.002 | 0 | 0.002 | Ni: 0.11, Mg: 0.02 | 0.876 | Comp. Ex. |
| y | 0.09 | 0.62 | 1.22 | 0.012 | 0.002 | 0.32 | 0.001 | 0 | 0.001 | 0.002 | Sn: 0.04 | 0.876 | Comp. Ex. |
| z | 0.09 | 0.62 | 1.22 | 0.012 | 0.002 | 0.32 | 0.861 | 0.200 | 0.229 | 1.290 | | 0.876 | Comp. Ex |

Note)
In the table, mark ____ indicates that the value is outside the scope of the present invention;
mark * indicates that the value does not satisfy the relationship between Al and Si specified in the present invention; and
mark — indicates that the constituent is not contained.

TABLE B3

| Sample | Steel | Annealing temp., ° C. | Annealing time, sec | Cooling rate, ° C./sec | Cooling termination temp., ° C. | Holding temp. before coating, ° C. | Holding time, sec | Coating temp., ° C. | Al content of zinc bath, % | Alloying temp., ° C. | Alloying time, sec | Cooling rate, ° C./sec | Cooling temp., ° C. | Remarks |
|---|---|---|---|---|---|---|---|---|---|---|---|---|---|---|
| 1 | a | 800 | 150 | 10 | 400 | 400–450 | 60 | 450 | 0.11 | 500 | 25 | 10 | 180 | GA |
| 2 | b | 750 | 90 | 20 | 400 | — | — | 450 | 0.14 | 520 | 30 | 15 | 150 | GA |
| 3 | c | 800 | 100 | 40 | 420 | 360–400 | 420 | 470 | 0.16 | — | — | 10 | 180 | GI |
| 4 | d | 750 | 90 | 150 | 380 | — | — | 450 | 0.10 | 500 | 25 | 10 | 180 | GA |
| 5 | e | 780 | 150 | 3 | 370 | 350–380 | 300 | 440 | 0.12 | — | — | 10 | 180 | GI |
| 6 | f | 800 | 90 | 20 | 480 | — | — | 450 | 0.15 | — | — | 10 | 180 | GI |
| 7 | g | 750 | 200 | 20 | 410 | — | — | 450 | 0.15 | 500 | 30 | 10 | 180 | GA |
| 8 | h | 850 | 85 | 7 | 440 | 400–470 | 40 | 450 | 0.20 | 500 | 25 | 10 | 180 | GA |
| 9 | i | 750 | 150 | 10 | 360 | 360–440 | 200 | 450 | 0.11 | — | — | 10 | 180 | GI |
| 10 | j | 800 | 90 | 20 | 480 | 400–500 | 100 | 450 | 0.15 | 500 | 25 | 10 | 180 | GA |
| 11 | k | 750 | 110 | 5 | 440 | — | — | 450 | 0.20 | 500 | 30 | 10 | 180 | GA |
| 12 | l | 700 | 120 | 10 | 400 | 360–440 | 60 | 450 | 0.18 | 550 | 10 | 10 | 180 | GA |
| 13 | m | 800 | 200 | 15 | 430 | — | — | 460 | 0.20 | — | — | 10 | 200 | GI |
| 14 | n | 830 | 90 | 20 | 410 | 400–470 | 30 | 450 | 0.15 | — | — | 10 | 180 | GI |
| 15 | o | 800 | 120 | 6 | 420 | — | — | 460 | 0.14 | 520 | 15 | 10 | 180 | GA |
| 16 | p | 750 | 110 | 10 | 370 | — | — | 450 | 0.10 | 500 | 25 | 10 | 180 | GA |
| 17 | q | 820 | 90 | 20 | 480 | 430–500 | 30 | 450 | 0.09 | 580 | 30 | 10 | 180 | GA |
| 18 | r | 750 | 90 | 20 | 410 | — | — | 450 | 0.16 | 500 | 20 | 10 | 180 | GA |
| 19 | s | 870 | 150 | 9 | 440 | 370–440 | 300 | 450 | 0.13 | 500 | 25 | 10 | 180 | GA |
| 20 | t | 750 | 70 | 20 | 420 | — | — | 450 | 0.18 | 500 | 25 | 10 | 180 | GA |
| 21 | u | 830 | 90 | 10 | 480 | 400–490 | 30 | 450 | 0.17 | 500 | 25 | 10 | 180 | GA |
| 22 | v | 750 | 200 | 20 | 490 | 400–470 | 80 | 450 | 0.09 | — | — | 10 | 180 | GI |
| 23 | w | 800 | 120 | 5 | 400 | — | — | 440 | 0.14 | — | — | 10 | 180 | GI |
| 24 | x | 750 | 110 | 10 | 400 | — | — | 440 | 0.14 | 500 | 25 | 10 | 180 | GA |
| 25 | y | 800 | 120 | 5 | 400 | 400–470 | 80 | 440 | 0.14 | — | — | 10 | 180 | GI |
| 26 | z | 800 | 70 | 20 | 440 | — | — | 440 | 0.14 | 500 | 25 | 10 | 180 | GA |

Note)
In the table, mark ____ indicates that the value is outside the scope of the present invention; the heating rate after coating was constant and 10° C./sec; and
GA represents a hot-dip galvannealed steel sheet, and
GI represents a hot-dip galvanized steel sheet.

TABLE B4

(continuation from TABLE B3)

| Sample | Steel | Annealing temp., ° C. | Annealing time, sec | Cooling rate, ° C./sec | Cooling termination temp., ° C. | Holding temp. before coating, ° C. | Holding time, sec | Coating temp., ° C. | Al content of zinc bath, % | Alloying temp., ° C. | Alloying time, sec | Cooling rate, ° C./sec | Cooling temp., ° C. | Remarks |
|---|---|---|---|---|---|---|---|---|---|---|---|---|---|---|
| 27 | a | 600 | 90 | 20 | 360 | — | — | 470 | 0.08 | 500 | 30 | 10 | 180 | GA |
| 28 | a | 950 | 90 | 80 | 480 | 400–500 | 60 | 450 | 0.11 | 480 | 50 | 10 | 180 | GA |
| 29 | a | 750 | 5 | 20 | 440 | 430–500 | 20 | 450 | 0.20 | 500 | 30 | 10 | 180 | GA |
| 30 | a | 800 | 400 | 20 | 410 | — | — | 480 | 0.17 | 500 | 40 | 20 | 220 | GA |

TABLE B4-continued (continuation from TABLE B3)

| Sample | Steel | Annealing temp., ° C. | Annealing time, sec | Cooling rate, ° C./sec | Cooling termination temp., ° C. | Holding temp. before coating, ° C. | Holding time, sec | Coating temp., ° C. | Al content of zinc bath, % | Alloying temp., ° C. | Alloying time, sec | Cooling rate, ° C./sec | Cooling temp., ° C. | Remarks |
|---|---|---|---|---|---|---|---|---|---|---|---|---|---|---|
| 31 | a | 750 | 90 | 1 | 370 | 430–500 | 30 | 450 | 0.13 | 510 | 30 | 10 | 180 | GA |
| 32 | a | 800 | 110 | 10 | 300 | 370–440 | 300 | 450 | 0.09 | 480 | 50 | 10 | 180 | GA |
| 33 | a | 770 | 90 | 70 | 520 | 370–440 | 300 | 450 | 0.14 | 500 | 30 | 10 | 180 | GA |
| 34 | a | 830 | 150 | 10 | 420 | 400–490 | 650 | 480 | 0.18 | 500 | 30 | 10 | 180 | GA |
| 35 | a | 800 | 70 | 20 | 410 | 400–470 | 80 | 430 | 0.11 | 430 | 40 | 15 | 180 | GA |
| 36 | a | 750 | 90 | 25 | 440 | 370–440 | 140 | 480 | 0.16 | 620 | 20 | 10 | 100 | GA |
| 37 | a | 850 | 60 | 20 | 420 | — | — | 450 | 0.20 | 500 | 3 | 8 | 180 | GA |
| 38 | a | 750 | 90 | 80 | 480 | — | — | 450 | 0.12 | 500 | 130 | 10 | 180 | GA |
| 39 | a | 820 | 70 | 50 | 490 | 400–470 | 250 | 440 | 0.10 | 500 | 25 | 3 | 180 | GA |
| 40 | a | 750 | 100 | 20 | 360 | — | — | 450 | 0.08 | 500 | 30 | 10 | 300 | GA |
| 41 | a | 830 | 90 | 20 | 480 | 400–500 | 60 | 450 | 0.82 | 500 | 25 | 10 | 180 | GA |
| 42 | a | 600 | 90 | 20 | 360 | — | — | 470 | 0.08 | — | — | 10 | 180 | GI |
| 43 | a | 950 | 90 | 80 | 480 | 400–500 | 60 | 450 | 0.11 | — | — | 10 | 180 | GI |
| 44 | a | 750 | 5 | 20 | 440 | 430–500 | 20 | 450 | 0.20 | — | — | 10 | 180 | GI |
| 45 | a | 800 | 420 | 20 | 410 | — | — | 480 | 0.17 | — | — | 20 | 220 | GI |
| 46 | a | 750 | 90 | 1 | 370 | 430–500 | 30 | 450 | 0.13 | — | — | 10 | 180 | GI |
| 47 | a | 800 | 110 | 10 | 300 | 370–440 | 300 | 450 | 0.09 | — | — | 10 | 180 | GI |
| 48 | a | 830 | 150 | 10 | 420 | 400–490 | 720 | 480 | 0.18 | — | — | 10 | 180 | GI |
| 49 | a | 820 | 70 | 50 | 490 | 400–470 | 250 | 440 | 0.10 | — | — | 3 | 180 | GI |
| 50 | a | 750 | 100 | 20 | 360 | — | — | 450 | 0.08 | — | — | 10 | 300 | GI |
| 51 | a | 830 | 90 | 20 | 480 | 400–500 | 60 | 450 | 0.82 | — | — | 10 | 180 | GI |

Note)

In the table, mark __indicates that the value is outside the scope of the present invention; the heating rate after coating was constant and 10° C./sec; and GA represents a hot-dip galvannealed steel sheet, and GI represents a hot-dip galvanized steel sheet.

TABLE B5

| Sample | TS, MPa | El, % | Retained γ, % | Zn content of coating, % | Fe content of coating, % | Al content of coating, % | Appearance of coating | Plating adhesion | Weldability | Remarks |
|---|---|---|---|---|---|---|---|---|---|---|
| 1 | 630 | 36 | 8 | 89 | 10 | 0.22 | ○ | ◎ | ◎ | Ex. of inv. |
| 2 | 660 | 34 | 10 | 89 | 10 | 0.18 | ○ | ◎ | ◎ | Ex. of inv. |
| 3 | 720 | 34 | 13 | 98 | — | 0.28 | ○ | ◎ | ○ | Ex. of inv. |
| 4 | 640 | 31 | 11 | 88 | 11 | 0.16 | ○ | ◎ | ◎ | Ex. of inv. |
| 5 | 780 | 30 | 3 | 94 | — | 0.18 | ○ | ◎ | ○ | Ex. of inv. |
| 6 | 580 | 36 | 9 | 89 | 10 | 0.82 | ○ | ◎ | ○ | Ex. of inv. |
| 7 | 840 | 31 | 15 | 89 | 10 | 0.13 | ○ | ○ | ◎ | Ex. of inv. |
| 8 | 640 | 36 | 8 | 87 | 12 | 0.16 | ○ | ◎ | ◎ | Ex. of inv. |
| 9 | 630 | 35 | 10 | 99 | — | 0.25 | ○ | ◎ | ○ | Ex. of inv. |
| 10 | 620 | 36 | 7 | 89 | 10 | 0.17 | ○ | ◎ | ◎ | Ex. of inv. |
| 11 | 810 | 31 | 18 | 89 | 10 | 0.23 | ○ | ◎ | ◎ | Ex. of inv. |
| 12 | 610 | 35 | 4 | 88 | 11 | 0.32 | ○ | ◎ | ◎ | Ex. of inv. |
| 13 | 830 | 32 | 15 | 99 | — | 0.18 | ○ | ○ | ○ | Ex. of inv. |
| 14 | 540 | 28 | 1 | 93 | — | 0.20 | ○ | ◎ | ○ | Comp. Ex. |
| 15 | 810 | 25 | 22 | 89 | 10 | 0.21 | ○ | ◎ | X | Comp. Ex. |
| 16 | 570 | 28 | 1 | 89 | 10 | 0.16 | ○ | ◎ | ◎ | Comp. Ex. |
| 17 | 710 | 30 | 8 | 93 | 6 | 0.32 | X | X | ○ | Comp. Ex. |
| 18 | 550 | 29 | 1 | 89 | 10 | 0.13 | ○ | ◎ | ◎ | Comp. Ex. |
| 19 | 620 | 33 | 6 | 89 | 10 | 0.19 | X | X | ○ | Comp. Ex. |
| 20 | 560 | 20 | 1 | 90 | 9 | 0.23 | ○ | ◎ | ◎ | Comp. Ex. |
| 21 | 700 | 34 | 7 | 89 | 10 | 0.28 | Δ | Δ | X | Comp. Ex. |
| 22 | 640 | 33 | 6 | 99 | — | 0.32 | X | X | ○ | Comp. Ex. |
| 23 | 660 | 33 | 5 | 94 | — | 0.28 | X | X | ○ | Comp. Ex. |
| 24 | 650 | 33 | 4 | 90 | 9 | 0.32 | X | X | ○ | Comp. Ex. |
| 25 | 665 | 33 | 5 | 96 | — | 0.29 | X | X | ○ | Comp. Ex. |
| 26 | 670 | 32 | 5 | 88 | 11 | 0.33 | X | ◎ | ○ | Comp. Ex. |

Note)

In the table, mark ____ indicates that the value is outside the scope of the present invention.

TABLE B6

(continuation from TABLE B5)

| Sample | TS, MPa | El, % | Retained γ, % | Zn content of coating, % | Fe content of coating, % | Al content of coating, % | Appearance of coating | Plating adhesion | Weldability | Remarks |
|---|---|---|---|---|---|---|---|---|---|---|
| 27 | 550 | 24 | 1 | 89 | 10 | 0.41 | ○ | ◎ | ◎ | Comp.Ex |
| 28 | 600 | 26 | 1 | 89 | 10 | 0.21 | ○ | ◎ | ◎ | Comp. Ex. |
| 29 | 620 | 20 | 1 | 90 | 9 | 0.23 | ○ | ◎ | ◎ | Comp. Ex. |
| 30 | 580 | 22 | 1 | 89 | 10 | 0.63 | ○ | ◎ | ◎ | Comp. Ex. |
| 31 | 550 | 26 | 1 | 89 | 10 | 0.27 | ○ | ◎ | ◎ | Comp. Ex. |
| 32 | 650 | 24 | 1 | 88 | 11 | 0.34 | ○ | ◎ | ◎ | Comp. Ex. |
| 33 | 610 | 34 | 6 | 84 | 15 | 0.28 | ○ | Δ | ○ | Comp. Ex. |
| 34 | 600 | 29 | 1 | 89 | 10 | 0.41 | ○ | ◎ | ◎ | Comp. Ex. |
| 35 | 610 | 35 | 5 | 94 | 5 | 0.23 | ○ | ◎ | ○ | Comp. Ex. |
| 36 | 570 | 29 | 1 | 84 | 15 | 0.23 | ○ | Δ | ○ | Comp. Ex. |
| 37 | 630 | 35 | 6 | 92 | 7 | 0.23 | ○ | ◎ | ○ | Comp. Ex. |
| 38 | 580 | 28 | 1 | 84 | 15 | 0.32 | ○ | Δ | ○ | Comp. Ex. |
| 39 | 580 | 26 | 1 | 89 | 10 | 0.23 | ○ | ◎ | ◎ | Comp. Ex. |
| 40 | 560 | 23 | 1 | 89 | 10 | 0.32 | ○ | ◎ | ◎ | Comp. Ex. |
| 41 | 630 | 35 | 7 | 88 | 10 | 1.23 | ○ | ◎ | ○ | Comp. Ex. |
| 42 | 550 | 24 | 1 | 89 | 10 | 0.41 | ○ | ◎ | ○ | Comp. Ex. |
| 43 | 600 | 26 | 1 | 89 | 10 | 0.21 | ○ | ◎ | ○ | Comp. Ex. |
| 44 | 620 | 20 | 1 | 90 | 9 | 0.23 | ○ | ◎ | ○ | Comp. Ex. |
| 45 | 580 | 22 | 1 | 89 | 10 | 0.63 | ○ | ◎ | ○ | Comp. Ex. |
| 46 | 550 | 26 | 1 | 89 | 10 | 0.27 | ○ | ◎ | ○ | Comp. Ex. |
| 47 | 650 | 24 | 1 | 88 | 11 | 0.34 | ○ | ◎ | ○ | Comp. Ex. |
| 48 | 600 | 29 | 1 | 89 | 10 | 0.41 | ○ | ◎ | ○ | Comp. Ex. |
| 49 | 580 | 26 | 1 | 89 | 10 | 0.23 | ○ | ◎ | ○ | Comp. Ex. |
| 50 | 560 | 23 | 1 | 89 | 10 | 0.32 | ○ | ◎ | ○ | Comp. Ex. |
| 51 | 630 | 35 | 7 | 88 | 10 | 1.23 | ○ | ◎ | ○ | Comp. Ex. |

Note)
In the table, mark ____ indicates that the value is outside the scope of the present invention.

Example B2

Steels having chemical compositions shown in Table B7 and Table B8 (continuation from Table B7) were reheated to 1250° C., were then finish rolled at 900° C., and were coiled at 650° C. to prepare 4 mm-thick hot rolled steel sheets. Scale deposited on the surface of the hot rolled steel sheets was removed with hydrochloric acid, and the steel sheets were then cold rolled to prepare 1.4 mm-thick cold rolled steel sheets. The cold rolled steel sheets were annealed under conditions shown in Table B9 and Table B10 (continuation from Table B9), were coated, and were then temper rolled with a reduction of 0.5%. The steel sheets thus obtained were subjected to the following performance evaluation tests, that is, "tensile test," "retained austenite measuring test," "welding test," "appearance of coating," "plating adhesion," and "measurement of concentration in coated layer." In the coating in the above production of the steel sheets, both sides of the cold rolled steel sheets were coated at a coverage of coating of 50 g/m$^2$ per side.

In the "tensile test," a JIS No. 5 tensile test piece was extracted in C-direction, and a cold tensile test was carried out under conditions of gauge thickness 50 mm and tensile speed 10 mm/min.

The "retained austenite measuring test" was carried out by a method called "5-peak" method. In this method, a quarter of the sheet thickness from the surface toward the inner side of the sheet was chemically polished, α-iron intensity and γ-iron intensity were then measured by X-ray diffractometry using an Mo bulb, and the volume fraction of retained austenite was determined based on the α-iron intensity and the γ-iron intensity.

The "welding test" was carried out by performing spot welding under welding conditions of welding current: 10 kA, applied pressure: 220 kg, welding time: 12 cycles, electrode diameter: 6 mm, electrode shape: domed, and tip: 6ϕ-40R, and counting the number of continuous spots provided until the welding reached the point at which the nugget diameter became below $4\sqrt{t}$ wherein t represents sheet thickness. The counted number of continuous spots was evaluated according to the following criteria. ◎: more than 2,000 continuous spots, ○: more than 1,000 continuous spots, Δ: 500 to 1,000 continuous spots, and ×: less than 500 continuous spots. Here ◎ and ○ were regarded as acceptable, and A and × as unacceptable.

The "appearance of coating" was determined by visually inspecting the appearance of the coated steel sheet for noncoated sites and evaluating the results according to the following criteria.

○: not more than 5/dm$^2$, Δ: 6 to 15/dm$^2$, and ×: not less than 16/dm$^2$.

Here ○ was regarded as acceptable, and Δ and × as unacceptable.

The "plating adhesion" was determined by subjecting the coated steel sheet to a 60-degree V bending test, then performing a tape test, and evaluating the results according to the following criteria.

Blackening in tape test (%)

◎: 0 to 10

○: 10 to less than 20

Δ: 20 to less than 30

×: not less than 30

(◎ and ○: acceptable, Δ and ×: unacceptable)

The "measurement of concentration in coated layer" was carried out by dissolving the coated layer in 5% hydrochloric acid containing an amine-based inhibitor and then analyzing the solution by ICP emission spectroscopy.

The results of the above performance evaluation tests are shown in Table B11 and Table B12 (continuation from Table B11). For all of samples 52 to 64 which are examples of the present invention, the total elongation was not less than 30% while ensuring a tensile strength of not less than 550 MPa, indicating that high strength and good press formability could be simultaneously realized. At the same time, for these samples, the plating adhesion was acceptable.

By contrast, samples 65 to 77, which are comparative examples, could not attain the object of the present invention due to poor strength-ductility balance or poor plating adhesion, because, for sample 65, the content of carbon (C) was lower than the carbon (C) content range specified in the present invention; for sample 66, the content of carbon (C) was higher than the carbon (C) content range specified in the present invention; for sample 67, the content of silicon (Si) was lower than the silicon (Si) content range specified in the present invention; for sample 68, the content of silicon (Si) was higher than the silicon (Si) content range specified in the present invention; samples 69 and 70 failed to satisfy the relationship between silicon (Si) and aluminum (Al) specified in the present invention; for sample 71, the content of manganese (Mn) was lower than the manganese (Mn) content range specified in the present invention; for sample 72, the content of manganese (Mn) was higher than the manganese (Mn) content range specified in the present invention; for sample 73, the content of aluminum (Al) was higher than the aluminum (Al) content range specified in the present invention; for samples 74, 75, and 76, the content of beryllium (Be)+calcium (Ca)+magnesium (Mg)+zirconium (Zr) was lower than the beryllium (Be)+calcium (Ca)+magnesium (Mg)+zirconium (Zr) content range specified in the present invention; and, for sample 77, the content of beryllium (Be)+calcium (Ca)+magnesium (Mg)+zirconium (Zr) was higher than the beryllium (Be)+calcium (Ca)+magnesium (Mg)+zirconium (Zr) content range specified in the present invention.

For samples 78 to 102 as comparative examples, although the chemical compositions of the steels fell within the scope of the present invention, any one of the treatment conditions was outside the scope of the present invention. These comparative samples suffered from poor strength-ductility balance or poor plating adhesion and thus could not attain the object of the present invention.

TABLE B7

| | Chemical composition, weight % | | | | | | | | | | | | | |
|---|---|---|---|---|---|---|---|---|---|---|---|---|---|---|
| Steel | C | Si | Mn | P | S | Al | Be | Ca | Mg | Zr | Be + Ca + Mg + Zr | Others | Si + 0.8 Al | Remarks |
| aa | 0.08 | 1.21 | 1.55 | 0.004 | 0.005 | 0.25 | 0.056 | 0 | 0 | 0 | 0.056 | — | 1.41 | Ex. of inv. |
| ab | 0.12 | 0.24 | 2.21 | 0.014 | 0.003 | 0.73 | 0 | 0.050 | 0 | 0 | 0.050 | Mo: 0.11, Bi: 0.02 | 0.824 | Ex. of inv. |
| ac | 0.16 | 1.30 | 1.40 | 0.008 | 0.004 | 0.02 | 0 | 0 | 0.022 | 0.022 | 0.044 | Sn: 0.05, Cr: 0.22 | 1.316 | Ex. of inv. |
| ad | 0.13 | 0.65 | 1.00 | 0.009 | 0.006 | 0.74 | 0 | 0 | 0 | 0.120 | 0.120 | Ni: 0.12 | 1.242 | Ex. of inv. |
| ae | 0.04 | 1.30 | 2.40 | 0.015 | 0.002 | 0.21 | 0.082 | 0.060 | 0.043 | 0.020 | 0.205 | Ce: 0.002, Nb: 0.03 | 1.468 | Ex. of inv. |
| af | 0.07 | 0.34 | 0.90 | 0.012 | 0.012 | 0.65 | 0.008 | 0.002 | 0.008 | 0.001 | 0.019 | Ti: 0.02, Zr: 0.05 | 0.86 | Ex. of inv. |
| ag | 0.17 | 1.70 | 1.50 | 0.005 | 0.008 | 0.23 | 0.112 | 0.200 | 0.100 | 0.100 | 0.512 | Sb: 0.003 | 1.884 | Ex. of inv. |
| ah | 0.09 | 0.82 | 1.40 | 0.005 | 0.004 | 0.34 | 0.187 | 0 | 0.742 | 0.030 | 0.959 | — | 1.092 | Ex. of inv. |
| ai | 0.11 | 0.46 | 1.60 | 0.012 | 0.011 | 0.95 | 0.742 | 0.110 | 0.046 | 0.020 | 0.918 | Y: 0.07, Se: 0.01 | 1.22 | Ex. of inv. |
| aj | 0.07 | 1.12 | 1.30 | 0.004 | 0.005 | 0.02 | 0.006 | 0.320 | 0.100 | 0 | 0.426 | — | 1.136 | Ex. of inv. |
| ak | 0.18 | 0.93 | 1.6 | 0.008 | 0.009 | 0.14 | 0 | 0.230 | 0.230 | 0.060 | 0.520 | Mo: 0.04, Ti: 0.01, Sb: 0.02 | 1.042 | Ex. of inv. |
| al | 0.08 | 0.82 | 1.70 | 0.004 | 0.005 | 0.13 | 0.046 | 0.020 | 0 | 0.010 | 0.076 | — | 0.924 | Ex. of inv. |
| am | 0.17 | 1.40 | 1.70 | 0.005 | 0.008 | 0.23 | 0 | 0.200 | 0.102 | 0.100 | 0.402 | Co: 0.05 | 1.584 | Ex. of inv. |

Note)
In the table, mark ____ indicates that the value is outside the scope of the present invention;
mark * indicates that the value does not satisfy the relationship between Al and Si specified in the present invention; and
mark — indicates that the constituent is not contained.

TABLE B8

(continuation from TABLE 7)

| | Chemical composition, weight % | | | | | | | | | | | | | |
|---|---|---|---|---|---|---|---|---|---|---|---|---|---|---|
| Steel | C | Si | Mn | P | S | Al | Be | Ca | Mg | Zr | Be + Ca + Mg + Zr | Others | Si + 0.8 Al | Remarks |
| an | 0.01 | 0.34 | 1.03 | 0.003 | 0.005 | 0.55 | 0.028 | 0.010 | 0.020 | 0.030 | 0.088 | — | 0.78 | Comp. Ex. |
| ao | 0.22 | 0.62 | 1.82 | 0.013 | 0.002 | 0.22 | 0.102 | 0.020 | 0.112 | 0.020 | 0.254 | Sn: 0.05 | 0.796 | Comp. Ex. |
| ap | 0.13 | 0.13 | 1.34 | 0.007 | 0.003 | 0.39 | 0.043 | 0.020 | 0.010 | 0 | 0.073 | Ce: 0.2 | 0.442 | Comp. Ex. |
| aq | 0.16 | 1.92 | 0.97 | 0.008 | 0.002 | 0.24 | 0 | 0.002 | 0.030 | 0.002 | 0.034 | — | 2.112 | Comp. Ex. |
| ar | 0.15 | *0.22 | 0.58 | 0.004 | 0.007 | *0.12 | 0.210 | 0.020 | 0.112 | 0.230 | 0.572 | V: 0.01, Zr: 0.02 | 0.316 | Comp. Ex. |
| as | 0.12 | *1.55 | 1.52 | 0.005 | 0.003 | *0.73 | 0.192 | 0.080 | 0 | 0.130 | 0.402 | — | 2.134 | Comp. Ex. |
| at | 0.06 | 0.36 | 0.18 | 0.008 | 0.003 | 0.22 | 0.062 | 0.042 | 0.008 | 0.220 | 0.332 | Cu: 0.22, Bi: 0.021 | 0.536 | Comp. Ex. |
| au | 0.14 | 0.73 | 2.65 | 0.009 | 0.005 | 0.54 | 0 | 0.230 | 0.130 | 0 | 0.360 | Cr: 0.23, Mo: 0.09 | 1.162 | Comp. Ex. |
| av | 0.12 | 0.54 | 0.85 | 0.005 | 0.006 | 1.63 | 0.008 | 0.010 | 0.010 | 0.023 | 0.051 | — | 1.844 | Comp. Ex. |
| aw | 0.09 | 0.62 | 1.22 | 0.012 | 0.002 | 0.32 | 0.001 | 0 | 0 | 0 | 0.001 | Ti: 0.03, Nb: 0.03 | 0.876 | Comp. Ex. |
| ax | 0.09 | 0.62 | 1.22 | 0.012 | 0.002 | 0.32 | 0 | 0.002 | 0.001 | 0 | 0.003 | Ni: 0.11, Sb: 0.02 | 0.876 | Comp. Ex. |
| ay | 0.09 | 0.62 | 1.22 | 0.012 | 0.002 | 0.32 | 0.001 | 0 | 0 | 0.001 | 0.002 | Sn: 0.04 | 0.876 | Comp. Ex. |
| az | 0.09 | 0.62 | 1.22 | 0.012 | 0.002 | 0.32 | 0.861 | 0.200 | 0.112 | 0.229 | 1.402 | | 0.876 | Comp. Ex. |

Note)
In the table, mark ____ indicates that the value is outside the scope of the present invention;
mark * indicates that the value does not satisfy the relationship between Al and Si specified in the present invention; and
mark — indicates that the constituent is not contained.

TABLE B9

| Sample | Steel | Annealing temp., ° C. | Annealing time, sec | Cooling rate, ° C./sec | Cooling termination temp., ° C. | Holding temp. before coating, ° C. | Holding time, sec | Coating temp., ° C. | Al content of zinc bath, % | Alloying temp., ° C. | Alloying time, sec | Cooling rate, ° C./sec | Cooling temp., ° C. | Remarks |
|---|---|---|---|---|---|---|---|---|---|---|---|---|---|---|
| 52 | aa | 800 | 150 | 10 | 400 | 400–450 | 60 | 450 | 0.11 | 500 | 25 | 10 | 180 | GA |
| 53 | ab | 750 | 90 | 20 | 400 | — | — | 450 | 0.14 | 520 | 30 | 15 | 150 | GA |
| 54 | ac | 800 | 100 | 40 | 420 | 360–400 | 420 | 470 | 0.16 | — | — | 10 | 180 | GI |
| 55 | ad | 750 | 90 | 150 | 380 | — | — | 450 | 0.10 | 500 | 25 | 10 | 180 | GA |
| 56 | ae | 780 | 150 | 3 | 370 | 350–380 | 300 | 440 | 0.12 | — | — | 10 | 180 | GI |
| 57 | af | 800 | 90 | 20 | 480 | — | — | 450 | 0.15 | — | — | 10 | 180 | GI |
| 58 | ag | 750 | 200 | 20 | 410 | — | — | 450 | 0.15 | 500 | 30 | 10 | 180 | GA |
| 59 | ah | 850 | 85 | 7 | 440 | 400–470 | 40 | 450 | 0.20 | 500 | 25 | 10 | 180 | GA |
| 60 | ai | 750 | 150 | 10 | 360 | 360–440 | 200 | 450 | 0.11 | — | — | 10 | 180 | GI |
| 61 | aj | 800 | 90 | 20 | 480 | 400–500 | 100 | 450 | 0.15 | 500 | 25 | 10 | 180 | GA |
| 62 | ak | 750 | 110 | 5 | 440 | — | — | 450 | 0.20 | 500 | 30 | 10 | 180 | GA |
| 63 | al | 700 | 120 | 10 | 400 | 360–440 | 60 | 450 | 0.18 | 550 | 10 | 10 | 180 | GA |
| 64 | am | 800 | 200 | 15 | 430 | — | — | 460 | 0.20 | — | — | 10 | 200 | GI |
| 65 | an | 830 | 90 | 20 | 410 | 400–470 | 30 | 450 | 0.15 | — | — | 10 | 180 | GI |
| 66 | ao | 800 | 120 | 6 | 420 | — | — | 460 | 0.14 | 520 | 15 | 10 | 180 | GA |
| 67 | ap | 750 | 110 | 10 | 370 | — | — | 450 | 0.10 | 500 | 25 | 10 | 180 | GA |
| 68 | aq | 820 | 90 | 20 | 480 | 430–500 | 30 | 450 | 0.09 | 580 | 30 | 10 | 180 | GA |
| 69 | ar | 750 | 90 | 20 | 410 | — | — | 450 | 0.16 | 500 | 20 | 10 | 180 | GA |
| 70 | as | 870 | 150 | 9 | 440 | 370–440 | 300 | 450 | 0.13 | 500 | 25 | 10 | 180 | GA |
| 71 | at | 750 | 70 | 20 | 420 | — | — | 450 | 0.18 | 500 | 25 | 10 | 180 | GA |
| 72 | au | 830 | 90 | 10 | 480 | 400–490 | 30 | 450 | 0.17 | 500 | 25 | 10 | 180 | GA |
| 73 | av | 750 | 200 | 20 | 490 | 400–470 | 80 | 450 | 0.09 | — | — | 10 | 180 | GI |
| 74 | aw | 800 | 120 | 5 | 400 | — | — | 440 | 0.14 | — | — | 10 | 180 | GI |
| 75 | ax | 750 | 110 | 10 | 400 | — | — | 440 | 0.14 | 500 | 25 | 10 | 180 | GA |
| 76 | ay | 800 | 120 | 5 | 400 | 400–470 | 80 | 440 | 0.14 | — | — | 10 | 180 | GI |
| 77 | az | 800 | 70 | 20 | 440 | — | — | 440 | 0.14 | 500 | 25 | 10 | 180 | GA |

Note)
In the table, mark ____ indicates that the value is outside the scope of the present invention; the heating rate after coating was constant and 10° C./sec; and
GA represents a hot-dip galvannealed steel sheet, and
GI represents a hot-dip galvanized steel sheet.

TABLE B10

(continuation from TABLE B9)

| Sample | Steel | Annealing temp., ° C. | Annealing time, sec | Cooling rate, ° C./sec | Cooling termination temp., ° C. | Holding temp. before coating, ° C. | Holding time, sec | Coating temp., ° C. | Al content of zinc bath, % | Alloying temp., ° C. | Alloying time, sec | Cooling rate, ° C./sec | Cooling temp., ° C. | Remarks |
|---|---|---|---|---|---|---|---|---|---|---|---|---|---|---|
| 78 | aa | 600 | 90 | 20 | 360 | — | — | 470 | 0.08 | 500 | 30 | 10 | 180 | GA |
| 79 | aa | 950 | 90 | 80 | 480 | 400–500 | 60 | 450 | 0.11 | 480 | 50 | 10 | 180 | GA |
| 80 | aa | 750 | 5 | 20 | 440 | 430–500 | 20 | 450 | 0.20 | 500 | 30 | 10 | 180 | GA |
| 81 | aa | 800 | 400 | 20 | 410 | — | — | 480 | 0.17 | 500 | 40 | 20 | 220 | GA |
| 82 | aa | 750 | 90 | 1 | 370 | 430–500 | 30 | 450 | 0.13 | 510 | 30 | 10 | 180 | GA |
| 83 | aa | 800 | 110 | 10 | 300 | 370–440 | 300 | 450 | 0.09 | 480 | 50 | 10 | 180 | GA |
| 84 | aa | 770 | 90 | 70 | 520 | 370–440 | 300 | 450 | 0.14 | 500 | 30 | 10 | 180 | GA |
| 85 | aa | 830 | 150 | 10 | 420 | 400–490 | 650 | 480 | 0.18 | 500 | 30 | 10 | 180 | GA |
| 86 | aa | 800 | 70 | 20 | 410 | 400–470 | 80 | 430 | 0.11 | 430 | 40 | 15 | 180 | GA |
| 87 | aa | 750 | 90 | 25 | 440 | 370–440 | 140 | 480 | 0.16 | 620 | 20 | 10 | 100 | GA |
| 88 | aa | 850 | 60 | 20 | 420 | — | — | 450 | 0.20 | 500 | 3 | 8 | 180 | GA |
| 89 | aa | 750 | 90 | 80 | 480 | — | — | 450 | 0.12 | 500 | 130 | 10 | 180 | GA |
| 90 | aa | 820 | 70 | 50 | 490 | 400–470 | 250 | 440 | 0.10 | 500 | 25 | 3 | 180 | GA |
| 91 | aa | 750 | 100 | 20 | 360 | — | — | 450 | 0.08 | 500 | 30 | 10 | 300 | GA |
| 92 | aa | 830 | 90 | 20 | 480 | 400–500 | 60 | 450 | 0.82 | 500 | 25 | 10 | 180 | GA |
| 93 | aa | 600 | 90 | 20 | 360 | — | — | 470 | 0.08 | — | — | 10 | 180 | GI |
| 94 | aa | 950 | 90 | 80 | 480 | 400–500 | 60 | 450 | 0.11 | — | — | 10 | 180 | GI |
| 95 | aa | 750 | 5 | 20 | 440 | 430–500 | 20 | 450 | 0.20 | — | — | 10 | 180 | GI |
| 96 | aa | 800 | 420 | 20 | 410 | — | — | 480 | 0.17 | — | — | 20 | 220 | GI |
| 97 | as | 750 | 90 | 1 | 370 | 430–500 | 30 | 450 | 0.13 | — | — | 10 | 180 | GI |
| 98 | aa | 800 | 110 | 10 | 300 | 370–440 | 300 | 450 | 0.09 | — | — | 10 | 180 | GI |
| 99 | aa | 830 | 150 | 10 | 420 | 400–490 | 720 | 480 | 0.18 | — | — | 10 | 180 | GI |
| 100 | aa | 820 | 70 | 50 | 490 | 400–470 | 250 | 440 | 0.10 | — | — | 3 | 180 | GI |
| 101 | aa | 750 | 100 | 20 | 360 | — | — | 450 | 0.08 | — | — | 10 | 300 | GI |
| 102 | aa | 830 | 90 | 20 | 480 | 400–500 | 60 | 450 | 0.82 | — | — | 10 | 180 | GI |

Note)
In the table, mark ____ indicates that the value is outside the scope of the present invention; the heating rate after coating was constant and 10° C./sec; and
GA represents a hot-dip galvannealed steel sheet, and
GI represents a hot-dip galvanized steel sheet.

TABLE B11

| Sample | TS, MPa | El, % | Retained γ, % | Zn content of coating, % | Fe content of coating, % | Al content of coating, % | Appearance of coating | Plating adhesion | Weldability | Remarks |
|---|---|---|---|---|---|---|---|---|---|---|
| 52 | 630 | 36 | 8 | 89 | 10 | 0.22 | ○ | ◎ | ◎ | Ex. of inv. |
| 53 | 660 | 34 | 10 | 89 | 10 | 0.18 | ○ | ◎ | ◎ | Ex. of inv. |
| 54 | 720 | 34 | 13 | 98 | — | 0.28 | ○ | ◎ | ○ | Ex. of inv. |
| 55 | 640 | 31 | 11 | 88 | 11 | 0.16 | ○ | ◎ | ◎ | Ex. of inv. |
| 56 | 780 | 30 | 3 | 94 | — | 0.18 | ○ | ◎ | ○ | Ex. of inv. |
| 57 | 580 | 36 | 9 | 89 | 10 | 0.82 | ○ | ◎ | ○ | Ex. of inv. |
| 58 | 840 | 31 | 15 | 89 | 10 | 0.13 | ○ | ○ | ◎ | Ex. of inv. |
| 59 | 640 | 36 | 8 | 87 | 12 | 0.16 | ○ | ◎ | ◎ | Ex. of inv. |
| 60 | 630 | 35 | 10 | 99 | — | 0.25 | ○ | ◎ | ○ | Ex. of inv. |
| 61 | 620 | 36 | 7 | 89 | 10 | 0.17 | ○ | ◎ | ◎ | Ex. of inv. |
| 62 | 810 | 31 | 18 | 89 | 10 | 0.23 | ○ | ◎ | ◎ | Ex. of inv. |
| 63 | 610 | 35 | 4 | 88 | 11 | 0.32 | ○ | ◎ | ◎ | Ex. of inv. |
| 64 | 830 | 32 | 15 | 99 | — | 0.18 | ○ | ○ | ○ | Ex. of inv. |
| 65 | 540 | 28 | 1 | 93 | — | 0.20 | ○ | ◎ | ○ | Comp. Ex. |
| 66 | 810 | 25 | 22 | 89 | 10 | 0.21 | ○ | ◎ | X | Comp. Ex. |
| 67 | 570 | 28 | 1 | 89 | 10 | 0.16 | ○ | ◎ | ◎ | Comp. Ex. |
| 68 | 710 | 30 | 8 | 93 | 6 | 0.32 | X | X | ○ | Comp. Ex. |
| 69 | 550 | 29 | 1 | 89 | 10 | 0.13 | ○ | ◎ | ◎ | Comp. Ex. |
| 70 | 620 | 33 | 6 | 89 | 10 | 0.19 | X | X | ○ | Comp. Ex. |
| 71 | 560 | 20 | 1 | 90 | 9 | 0.23 | ○ | ◎ | ◎ | Comp. Ex. |
| 72 | 700 | 34 | 7 | 89 | 10 | 0.28 | Δ | Δ | X | Comp. Ex. |
| 73 | 640 | 33 | 6 | 99 | — | 0.32 | X | X | ○ | Comp. Ex. |
| 74 | 660 | 33 | 5 | 94 | — | 0.28 | X | X | ○ | Comp. Ex. |
| 75 | 650 | 33 | 4 | 90 | 9 | 0.32 | X | X | ○ | Comp. Ex. |
| 76 | 665 | 33 | 5 | 96 | — | 0.29 | X | X | ○ | Comp. Ex. |
| 77 | 670 | 32 | 5 | 88 | 11 | 0.33 | X | ◎ | ○ | Comp. Ex. |

Note)
In the table, mark ____ indicates that the value is outside the scope of the present invention.

TABLE B12

(continuation from TABLE B11)

| Sample | TS, MPa | El, % | Retained γ, % | Zn content of coating, % | Fe content of coating, % | Al content of coating, % | Appearance of coating | Plating adhesion | Weldability | Remarks |
|---|---|---|---|---|---|---|---|---|---|---|
| 78 | 550 | 24 | 1 | 89 | 10 | 0.41 | ○ | ◎ | ◎ | Comp. Ex. |
| 79 | 600 | 26 | 1 | 89 | 10 | 0.21 | ○ | ◎ | ◎ | Comp. Ex. |
| 80 | 620 | 20 | 1 | 90 | 9 | 0.23 | ○ | ◎ | ◎ | Comp. Ex. |
| 81 | 580 | 22 | 1 | 89 | 10 | 0.63 | ○ | ◎ | ◎ | Comp. Ex. |
| 82 | 550 | 26 | 1 | 89 | 10 | 0.27 | ○ | ◎ | ◎ | Comp. Ex. |
| 83 | 650 | 24 | 1 | 88 | 11 | 0.34 | ○ | ◎ | ◎ | Comp. Ex. |
| 84 | 610 | 34 | 6 | 84 | 15 | 0.28 | ○ | Δ | ○ | Comp. Ex. |
| 85 | 600 | 29 | 1 | 89 | 10 | 0.41 | ○ | ◎ | ◎ | Comp. Ex. |
| 86 | 610 | 35 | 5 | 94 | 5 | 0.23 | ○ | ◎ | ○ | Comp. Ex. |
| 87 | 570 | 29 | 1 | 84 | 15 | 0.23 | ○ | Δ | ○ | Comp. Ex. |
| 88 | 630 | 35 | 6 | 92 | 7 | 0.23 | ○ | ◎ | ○ | Comp. Ex. |
| 89 | 580 | 28 | 1 | 84 | 15 | 0.32 | ○ | Δ | ○ | Comp. Ex. |
| 90 | 580 | 26 | 1 | 89 | 10 | 0.23 | ○ | ◎ | ◎ | Comp. Ex. |
| 91 | 560 | 23 | 1 | 89 | 10 | 0.32 | ○ | ◎ | ◎ | Comp. Ex. |
| 92 | 630 | 35 | 7 | 88 | 10 | 1.23 | ○ | ◎ | ○ | Comp. Ex. |
| 93 | 550 | 24 | 1 | 89 | 10 | 0.41 | ○ | ◎ | ○ | Comp. Ex. |
| 94 | 600 | 26 | 1 | 89 | 10 | 0.21 | ○ | ◎ | ○ | Comp. Ex. |
| 95 | 620 | 20 | 1 | 90 | 9 | 0.23 | ○ | ◎ | ○ | Comp. Ex. |
| 96 | 580 | 22 | 1 | 89 | 10 | 0.63 | ○ | ◎ | ○ | Comp. Ex. |
| 97 | 550 | 26 | 1 | 89 | 10 | 0.27 | ○ | ◎ | ○ | Comp. Ex. |
| 98 | 650 | 24 | 1 | 88 | 11 | 0.34 | ○ | ◎ | ○ | Comp. Ex. |
| 99 | 600 | 29 | 1 | 89 | 10 | 0.41 | ○ | ◎ | ○ | Comp. Ex. |
| 100 | 580 | 26 | 1 | 89 | 10 | 0.23 | ○ | ◎ | ○ | Comp. Ex. |
| 101 | 560 | 23 | 1 | 89 | 10 | 0.32 | ○ | ◎ | ○ | Comp. Ex. |
| 102 | 630 | 35 | 7 | 88 | 10 | 1.23 | ○ | ◎ | ○ | Comp. Ex. |

Note)
In the table, mark ____ indicates that the value is outside the scope of the present invention.

Example B3

Steels having chemical compositions shown in Table B13 and Table B14 (continuation from Table B13) were reheated to 1250° C., were then finish rolled at 900° C., and were coiled at 650° C. to prepare 4 mm-thick hot rolled steel sheets. Scale deposited on the surface of the hot rolled steel sheets was removed with hydrochloric acid, and the steel sheets were then cold rolled to prepare 1.4 mm-thick cold rolled steel sheets. The cold rolled steel sheets were annealed under conditions shown in Table B15 and Table B16 (continuation from Table B15), were coated, and were then temper rolled with a reduction of 0.5%. The steel sheets thus obtained were subjected to the following performance evaluation tests, that is, "tensile test," "retained austenite measuring test," "welding test," "appearance of coating,"

"plating adhesion," and "measurement of concentration in coated layer." In the coating in the above production of the steel sheets, both sides of the cold rolled steel sheets were coated at a coverage of coating of 50 g/m$^2$ per side.

In the "tensile test," a JIS No. 5 tensile test piece was extracted in C-direction, and a cold tensile test was carried out under conditions of gauge thickness 50 mm and tensile speed 10 mm/min.

The "retained austenite measuring test" was carried out by a method called "5-peak" method. In this method,a quarter of the sheet thickness from the surface toward the inner side of the sheet was chemically polished, α-iron intensity and γ-iron intensity were then measured by X-ray diffractometry using an Mo bulb, and the volume fraction of retained austenite was determined based on the α-iron intensity and the γ-iron intensity.

The "welding test" was carried out by performing spot welding under welding conditions of welding current: 10 kA, applied pressure: 220 kg, welding time: 12 cycles, electrode diameter: 6 mm, electrode shape: domed, and tip: 6ϕ-40R, and counting the number of continuous spots provided until the welding reached the point at which the nugget diameter became below $4\sqrt{t}$ wherein t represents sheet thickness. The counted number of continuous spots was evaluated according to the following criteria. ◎: more than 2,000 continuous spots, ○: more than 1,000 continuous spots, Δ: 500 to 1,000 continuous spots, and ×: less than 500 continuous spots. Here ◎ and ○ were regarded as acceptable, and Δ and × as unacceptable.

The "appearance of coating" was determined by visually inspecting the appearance of the coated steel sheet for noncoated sites and evaluating the results according to the following criteria.

○: not more than 5/dm$^2$, Δ: 6 to 15/dm$^2$, and ×: not less than 16/dm$^2$.

Here ○ was regarded as acceptable, and Δ and × as unacceptable.

The "plating adhesion" was determined by subjecting the plated steel sheet to a 60-degree V bending test, then performing a tape test, and evaluating the results according to the following criteria.

Blackening in tape test (%)

◎: 0 to 10

○: 10 to less than 20

Δ: 20 to less than 30

×: not less than 30

(◎ and ○: acceptable, Δand ×: unacceptable)

The "measurement of concentration in coated layer" was carried out by dissolving the coating layer in 5% hydrochloric acid containing an amine-based inhibitor and then analyzing the solution by ICP emission spectroscopy.

The results of the above performance evaluation tests are shown in Table B17 and Table B18 (continuation from Table B17). For all of samples 103 to 115 which are examples of the present invention, the total elongation was not less than 30% while ensuring a tensile strength of not less than 550 MPa, indicating that high strength and good press formability could be simultaneously realized. At the same time, for these samples, the plating adhesion was acceptable.

By contrast, samples 116 to 128, which are comparative examples, could not attain the object of the present invention due to poor strength-ductility balance or poor plating adhesion, because, for sample 116, the content of carbon (C) was lower than the carbon (C) content range specified in the present invention; for sample 117, the content of carbon (C) was higher than the carbon (C) content range specified in the present invention; for sample 118, the content of silicon (Si) was lower than the silicon (Si) content range specified in the present invention; for sample 119, the content of silicon (Si) was higher than the silicon (Si) content range specified in the present invention; samples 120 and 121 failed to satisfy the relationship between silicon (Si) and aluminum (Al) specified in the present invention; for sample 122, the content of manganese (Mn) was lower than the manganese (Mn) content range specified in the present invention; for sample 123, the content of manganese (Mn) was higher than the manganese (Mn) content range specified in the present invention; for sample 124, the content of aluminum (Al) was higher than the aluminum (Al) content range specified in the present invention; for samples 125, 126, and 127, the content of scandium (Sc)+yttrium (Y)+lanthanum (La)+cerium (Ce) was lower than the scandium (Sc)+yttrium (Y)+lanthanum (La)+cerium (Ce) content range specified in the present invention; and, for sample 128, the content of scandium+yttrium+lanthanum+cerium was higher than the scandium +yttrium+lanthanum+cerium content range specified in the present invention.

For samples 129 to 153 (see Table B18) as comparative examples, although the chemical compositions of the steels fell within the scope of the present invention, any one of the treatment conditions was outside the scope of the present invention. These comparative samples suffered from poor strength-ductility balance or poor plating adhesion and thus could not attain the object of the present invention.

TABLE B13

| | Chemical composition, weight % | | | | | | | | | | | | | |
|---|---|---|---|---|---|---|---|---|---|---|---|---|---|---|
| Steel | C | Si | Mn | P | S | Al | Sc | Y | La | Ce | Sc + Y + La + Ce | Others | Si + 0.8 Al | Remarks |
| ba | 0.08 | 1.21 | 1.55 | 0.004 | 0.005 | 0.25 | 0.056 | 0 | 0 | 0 | 0.056 | — | 1.41 | Ex. of inv. |
| bb | 0.12 | 0.24 | 2.21 | 0.014 | 0.003 | 0.73 | 0 | 0.050 | 0 | 0 | 0.050 | Mo: 0.11, Ca: 0.02 | 0.824 | Ex. of inv. |
| bc | 0.16 | 1.30 | 1.40 | 0.008 | 0.004 | 0.02 | 0 | 0 | 0.022 | 0.022 | 0.044 | Sn: 0.05, Cr: 0.22 | 1.316 | Ex. of inv. |
| bd | 0.13 | 0.65 | 1.00 | 0.009 | 0.006 | 0.74 | 0 | 0 | 0 | 0.120 | 0.120 | Ni: 0.12 | 1.242 | Ex. of inv. |
| be | 0.04 | 1.30 | 2.40 | 0.015 | 0.002 | 0.21 | 0.082 | 0.060 | 0.043 | 0.020 | 0.205 | Sb: 0.002, Nb: 0.03 | 1.468 | Ex. of inv. |
| bf | 0.07 | 0.34 | 0.90 | 0.012 | 0.012 | 0.65 | 0.008 | 0.002 | 0.008 | 0.001 | 0.019 | Ti: 0.02, Zr: 0.05 | 0.86 | Ex. of inv. |
| bg | 0.17 | 1.70 | 1.50 | 0.005 | 0.008 | 0.23 | 0.112 | 0.200 | 0.100 | 0.100 | 0.512 | Mg: 0.003 | 1.884 | Ex. of inv. |
| bh | 0.09 | 0.82 | 1.40 | 0.005 | 0.004 | 0.34 | 0.187 | 0 | 0.742 | 0.030 | 0.959 | — | 1.092 | Ex. of inv. |
| bi | 0.11 | 0.46 | 1.60 | 0.012 | 0.011 | 0.95 | 0.742 | 0.110 | 0.046 | 0.020 | 0.918 | Bi: 0.07, Ca: 0.01 | 1.22 | Ex. of inv. |
| bj | 0.07 | 1.12 | 1.30 | 0.004 | 0.005 | 0.02 | 0.006 | 0.320 | 0.100 | 0 | 0.426 | — | 1.136 | Ex. of inv. |
| bk | 0.18 | 0.93 | 1.6 | 0.008 | 0.009 | 0.14 | 0 | 0.230 | 0.230 | 0.060 | 0.520 | Mo: 0.04, Ti: 0.01, Mg: 0.02 | 1.042 | Ex. of inv. |
| bl | 0.08 | 0.82 | 1.70 | 0.004 | 0.005 | 0.13 | 0.046 | 0.020 | 0 | 0.010 | 0.076 | — | 0.924 | Ex. of inv. |
| bm | 0.17 | 1.40 | 1.70 | 0.005 | 0.008 | 0.23 | 0 | 0.200 | 0.102 | 0.100 | 0.402 | Mg: 0.02, Co: 0.05 | 1.584 | Ex. of inv. |

TABLE B14

(continuation from TABLE B13)

| Steel | Chemical composition, weight % | | | | | | | | | | | | | |
|---|---|---|---|---|---|---|---|---|---|---|---|---|---|---|
| | C | Si | Mn | P | S | Al | Sc | Y | La | Ce | Sc + Y + La + Ce | Others | Si + 0.8 Al | Remarks |
| bn | 0.01 | 0.34 | 1.03 | 0.003 | 0.005 | 0.55 | 0.028 | 0.010 | 0.020 | 0.030 | 0.088 | — | 0.78 | Comp. Ex. |
| bo | 0.22 | 0.62 | 1.82 | 0.013 | 0.002 | 0.22 | 0.102 | 0.020 | 0.112 | 0.020 | 0.254 | Sn: 0.05 | 0.796 | Comp. Ex. |
| bp | 0.13 | 0.13 | 1.34 | 0.007 | 0.003 | 0.39 | 0.043 | 0.020 | 0.010 | 0 | 0.073 | Se: 0.2 | 0.442 | Comp. Ex. |
| bq | 0.16 | 1.92 | 0.97 | 0.008 | 0.002 | 0.24 | 0 | 0.002 | 0.030 | 0.002 | 0.034 | — | 2.112 | Comp. Ex. |
| br | 0.15 | *0.22 | 0.58 | 0.004 | 0.007 | *0.12 | 0.210 | 0.020 | 0.112 | 0.230 | 0.572 | V: 0.01, Zr: 0.02 | 0.316 | Comp. Ex. |
| bs | 0.12 | *1.55 | 1.52 | 0.005 | 0.003 | *0.73 | 0.192 | 0.080 | 0 | 0.130 | 0.402 | — | 2.134 | Comp. Ex. |
| bt | 0.06 | 0.36 | 0.18 | 0.008 | 0.003 | 0.22 | 0.062 | 0.042 | 0.008 | 0.220 | 0.332 | Cu: 0.22, Ca: 0.021 | 0.536 | Comp. Ex. |
| bu | 0.14 | 0.73 | 2.65 | 0.009 | 0.005 | 0.54 | 0 | 0.230 | 0.130 | 0 | 0.360 | Cr: 0.23, Mo: 0.09 | 1.162 | Comp. Ex. |
| bv | 0.12 | 0.54 | 0.85 | 0.005 | 0.006 | 1.63 | 0.008 | 0.010 | 0.010 | 0.023 | 0.051 | — | 1.844 | Comp. Ex. |
| bw | 0.09 | 0.62 | 1.22 | 0.012 | 0.002 | 0.32 | 0.001 | 0 | 0 | 0 | 0.001 | Ti: 0.03, Nb: 0.03 | 0.876 | Comp. Ex. |
| bx | 0.09 | 0.62 | 1.22 | 0.012 | 0.002 | 0.32 | 0 | 0.002 | 0.001 | 0 | 0.003 | Ni: 0.11, Mg: 0.02 | 0.876 | Comp. Ex. |
| by | 0.09 | 0.62 | 1.22 | 0.012 | 0.002 | 0.32 | 0.001 | 0 | 0 | 0.001 | 0.002 | Sn: 0.04 | 0.876 | Comp. Ex. |
| bz | 0.09 | 0.62 | 1.22 | 0.012 | 0.002 | 0.32 | 0.861 | 0.200 | 0.112 | 0.229 | 1.402 | | 0.876 | Comp. Ex. |

TABLE B15

| Sample | Steel | Annealing temp., ° C. | Annealing time, sec | Cooling rate ° C./sec | Cooling termination temp., ° C. | Holding temp. before coating, ° C. | Holding time, sec | Coating temp., ° C. | Al content of zinc bath, % | Alloying temp., ° C. | Alloying time, sec | Cooling rate, ° C./sec | Cooling temp., ° C. | Remarks |
|---|---|---|---|---|---|---|---|---|---|---|---|---|---|---|
| 103 | ba | 800 | 150 | 10 | 400 | 400–450 | 60 | 450 | 0.11 | 500 | 25 | 10 | 180 | GA |
| 104 | bb | 750 | 90 | 20 | 400 | — | — | 450 | 0.14 | 520 | 30 | 15 | 150 | GA |
| 105 | bc | 800 | 100 | 40 | 420 | 360–400 | 420 | 470 | 0.16 | — | — | 10 | 180 | GI |
| 106 | bd | 750 | 90 | 150 | 380 | — | — | 450 | 0.10 | 500 | 25 | 10 | 180 | GA |
| 107 | be | 780 | 150 | 3 | 370 | 350–380 | 300 | 440 | 0.12 | — | — | 10 | 180 | GI |
| 108 | bf | 800 | 90 | 20 | 480 | — | — | 450 | 0.15 | — | — | 10 | 180 | GI |
| 109 | bg | 750 | 200 | 20 | 410 | — | — | 450 | 0.15 | 500 | 30 | 10 | 180 | GA |
| 110 | bh | 850 | 85 | 7 | 440 | 400–470 | 40 | 450 | 0.20 | 500 | 25 | 10 | 180 | GA |
| 111 | bi | 750 | 150 | 10 | 360 | 360–440 | 200 | 450 | 0.11 | — | — | 10 | 180 | GI |
| 112 | bj | 800 | 90 | 20 | 480 | 400–500 | 100 | 450 | 0.15 | 500 | 25 | 10 | 180 | GA |
| 113 | bk | 750 | 110 | 5 | 440 | — | — | 450 | 0.20 | 500 | 30 | 10 | 180 | GA |
| 114 | bl | 700 | 120 | 10 | 400 | 360–440 | 60 | 450 | 0.18 | 550 | 10 | 10 | 180 | GA |
| 115 | bm | 800 | 200 | 15 | 430 | — | — | 460 | 0.20 | — | — | 10 | 200 | GI |
| 116 | bn | 830 | 90 | 20 | 410 | 400–470 | 30 | 450 | 0.15 | — | — | 10 | 180 | GI |
| 117 | bo | 800 | 120 | 6 | 420 | — | — | 460 | 0.14 | 520 | 15 | 10 | 180 | GA |
| 118 | bp | 750 | 110 | 10 | 370 | — | — | 450 | 0.10 | 500 | 25 | 10 | 180 | GA |
| 119 | bq | 820 | 90 | 20 | 480 | 430–500 | 30 | 450 | 0.09 | 580 | 30 | 10 | 180 | GA |
| 120 | br | 750 | 90 | 20 | 410 | — | — | 450 | 0.16 | 500 | 20 | 10 | 180 | GA |
| 121 | bs | 870 | 150 | 9 | 440 | 370–440 | 300 | 450 | 0.13 | 500 | 25 | 10 | 180 | GA |
| 122 | bt | 750 | 70 | 20 | 420 | — | — | 450 | 0.18 | 500 | 25 | 10 | 180 | GA |
| 123 | bu | 830 | 90 | 10 | 480 | 400–490 | 30 | 450 | 0.17 | 500 | 25 | 10 | 180 | GA |
| 124 | bv | 750 | 200 | 20 | 490 | 400–470 | 80 | 450 | 0.09 | — | — | 10 | 180 | GI |
| 125 | bw | 800 | 120 | 5 | 400 | — | — | 440 | 0.14 | — | — | 10 | 180 | GI |
| 126 | bx | 750 | 110 | 10 | 400 | — | — | 440 | 0.14 | 500 | 25 | 10 | 180 | GA |
| 127 | by | 800 | 120 | 5 | 400 | 400–470 | 80 | 440 | 0.14 | — | — | 10 | 180 | GI |
| 128 | bz | 800 | 70 | 20 | 440 | — | — | 440 | 0.14 | 500 | 25 | 10 | 180 | GA |

Note)
In the table, mark _ indicates that the value is outside the scope of the present invention; the heating rate after coating was constant and 10° C./sec; and
GA represents a hot-dip galvannealed steel sheet, and
GI represents a hot-dip galvanized steel sheet.

TABLE B16

(continuation from Table B15)

| Sample | Steel | Annealing temp., ° C. | Annealing time, sec | Cooling rate, ° C./sec | Cooling termination temp., ° C. | Holding temp. before coating, ° C. | Holding time, sec | Coating temp., ° C. | Al content of zinc bath, % | Alloying temp., ° C. | Alloying time, sec | Cooling rate, ° C./sec | Cooling temp., ° C. | Remarks |
|---|---|---|---|---|---|---|---|---|---|---|---|---|---|---|
| 129 | ba | 600 | 90 | 20 | 360 | — | — | 470 | 0.08 | 500 | 30 | 10 | 180 | GA |
| 130 | ba | 950 | 90 | 80 | 480 | 400–500 | 60 | 450 | 0.11 | 480 | 50 | 10 | 180 | GA |
| 131 | ba | 750 | 5 | 20 | 440 | 430–500 | 20 | 450 | 0.20 | 500 | 30 | 10 | 180 | GA |
| 132 | ba | 800 | 400 | 20 | 410 | — | — | 480 | 0.17 | 500 | 40 | 20 | 220 | GA |
| 133 | ba | 750 | 90 | 1 | 370 | 430–500 | 30 | 450 | 0.13 | 510 | 30 | 10 | 180 | GA |
| 134 | ba | 800 | 110 | 10 | 300 | 370–440 | 300 | 450 | 0.09 | 480 | 50 | 10 | 180 | GA |
| 135 | ba | 770 | 90 | 70 | 520 | 370–440 | 300 | 450 | 0.14 | 500 | 30 | 10 | 180 | GA |
| 136 | ba | 830 | 150 | 10 | 420 | 400–490 | 650 | 480 | 0.18 | 500 | 30 | 10 | 180 | GA |
| 137 | ba | 800 | 70 | 20 | 410 | 400–470 | 80 | 430 | 0.11 | 430 | 40 | 15 | 180 | GA |
| 138 | ba | 750 | 90 | 25 | 440 | 370–440 | 140 | 480 | 0.16 | 620 | 20 | 10 | 100 | GA |
| 139 | ba | 850 | 60 | 20 | 420 | — | — | 450 | 0.20 | 500 | 3 | 8 | 180 | GA |
| 140 | ba | 750 | 90 | 80 | 480 | — | — | 450 | 0.12 | 500 | 130 | 10 | 180 | GA |
| 141 | ba | 820 | 70 | 50 | 490 | 400–470 | 250 | 440 | 0.10 | 500 | 25 | 3 | 180 | GA |
| 142 | ba | 750 | 100 | 20 | 360 | — | — | 450 | 0.08 | 500 | 30 | 10 | 300 | GA |
| 143 | ba | 830 | 90 | 20 | 480 | 400–500 | 60 | 450 | 0.82 | 500 | 25 | 10 | 180 | GA |
| 144 | ba | 600 | 90 | 20 | 360 | — | — | 470 | 0.08 | — | — | 10 | 180 | GI |
| 145 | ba | 950 | 90 | 80 | 480 | 400–500 | 60 | 450 | 0.11 | — | — | 10 | 180 | GI |
| 146 | ba | 750 | 5 | 20 | 440 | 430–500 | 20 | 450 | 0.20 | — | — | 10 | 180 | GI |
| 147 | ba | 800 | 420 | 20 | 410 | — | — | 480 | 0.17 | — | — | 20 | 220 | GI |
| 148 | ba | 750 | 90 | 1 | 370 | 430–500 | 30 | 450 | 0.13 | — | — | 10 | 180 | GI |
| 149 | ba | 800 | 110 | 10 | 300 | 370–440 | 300 | 450 | 0.09 | — | — | 10 | 180 | GI |
| 150 | ba | 830 | 150 | 10 | 420 | 400–490 | 720 | 480 | 0.18 | — | — | 10 | 180 | GI |
| 151 | ba | 820 | 70 | 50 | 490 | 400–470 | 250 | 440 | 0.10 | — | — | 3 | 180 | GI |
| 152 | ba | 750 | 100 | 20 | 360 | — | — | 450 | 0.08 | — | — | 10 | 300 | GI |
| 153 | ba | 830 | 90 | 20 | 480 | 400–500 | 60 | 450 | 0.82 | — | — | 10 | 180 | GI |

Note)
In the table, mark_indicates that the value is outside the scope of the present invention; the heating rate after coating was constant and 10° C./sec; and
GA represents a hot-dip galvannealed steel sheet, and
GI represents a hot-dip galvanized steel sheet.

TABLE B17

| Sample | TS, MPa | El, % | Retained γ, % | Zn content of coating, % | Fe content of coating, % | Al content of coating, % | Appearance of coating | Plating adhesion | Weldability | Remarks |
|---|---|---|---|---|---|---|---|---|---|---|
| 103 | 630 | 36 | 8 | 89 | 10 | 0.22 | ○ | ◎ | ◎ | Ex. of inv. |
| 104 | 660 | 34 | 10 | 89 | 10 | 0.18 | ○ | ◎ | ◎ | Ex. of inv. |
| 105 | 720 | 34 | 13 | 98 | — | 0.28 | ○ | ◎ | ○ | Ex. of inv. |
| 106 | 640 | 31 | 11 | 88 | 11 | 0.16 | ○ | ◎ | ◎ | Ex. of inv. |
| 107 | 780 | 30 | 3 | 94 | — | 0.18 | ○ | ◎ | ○ | Ex. of inv. |
| 108 | 580 | 36 | 9 | 89 | 10 | 0.82 | ○ | ◎ | ○ | Ex. of inv. |
| 109 | 840 | 31 | 15 | 89 | 10 | 0.13 | ○ | ○ | ◎ | Ex. of inv. |
| 110 | 640 | 36 | 8 | 87 | 12 | 0.16 | ○ | ◎ | ◎ | Ex. of inv. |
| 111 | 630 | 35 | 10 | 99 | — | 0.25 | ○ | ◎ | ○ | Ex. of inv. |
| 112 | 620 | 36 | 7 | 89 | 10 | 0.17 | ○ | ◎ | ◎ | Ex. of inv. |
| 113 | 810 | 31 | 18 | 89 | 10 | 0.23 | ○ | ◎ | ◎ | Ex. of inv. |
| 114 | 610 | 35 | 4 | 88 | 11 | 0.32 | ○ | ◎ | ◎ | Ex. of inv. |
| 115 | 830 | 32 | 15 | 99 | — | 0.18 | ○ | ○ | ○ | Ex. of inv. |
| 116 | 540 | 28 | 1 | 93 | — | 0.20 | ○ | ◎ | ○ | Comp. Ex. |
| 117 | 810 | 25 | 22 | 89 | 10 | 0.21 | ○ | ◎ | X | Comp. Ex. |
| 118 | 570 | 28 | 1 | 89 | 10 | 0.16 | ○ | ◎ | ◎ | Comp. Ex. |

TABLE B17-continued

| Sample | TS, MPa | El, % | Retained γ, % | Zn content of coating, % | Fe content of coating, % | Al content of coating, % | Appearance of coating | Plating adhesion | Weldability | Remarks |
|---|---|---|---|---|---|---|---|---|---|---|
| 119 | 710 | 30 | 8 | 93 | 6 | 0.32 | X | X | ○ | Comp. Ex. |
| 120 | 550 | 29 | 1 | 89 | 10 | 0.13 | ○ | ⊙ | ⊙ | Comp. Ex. |
| 121 | 620 | 33 | 6 | 89 | 10 | 0.19 | X | X | ○ | Comp. Ex. |
| 122 | 560 | 20 | 1 | 90 | 9 | 0.23 | ○ | ⊙ | ⊙ | Comp. Ex. |
| 123 | 700 | 34 | 7 | 89 | 10 | 0.28 | Δ | Δ | X | Comp. Ex. |
| 124 | 640 | 33 | 6 | 99 | — | 0.32 | X | X | ○ | Comp. Ex. |
| 125 | 660 | 33 | 5 | 94 | — | 0.28 | X | X | ○ | Comp. Ex. |
| 126 | 650 | 33 | 4 | 90 | 9 | 0.32 | X | X | ○ | Comp. Ex. |
| 127 | 665 | 33 | 5 | 96 | — | 0.29 | X | X | ○ | Comp. Ex. |
| 128 | 670 | 32 | 5 | 88 | 11 | 0.33 | X | ⊙ | ○ | Comp. Ex. |

Note)
In the table, mark_indicates that the value is outside the scope of the present invention.

TABLE B18

(continuation from Table B17)

| Sample | TS, MPa | El, % | Retained γ, % | Zn content of coating, % | Fe content of coating, % | Al content of coating, % | Appearance of coating | Plating adhesion | Weldability | Remarks |
|---|---|---|---|---|---|---|---|---|---|---|
| 129 | 550 | 24 | 1 | 89 | 10 | 0.41 | ○ | ⊙ | ⊙ | Comp. Ex |
| 130 | 600 | 26 | 1 | 89 | 10 | 0.21 | ○ | ⊙ | ⊙ | Comp. Ex. |
| 131 | 620 | 20 | 1 | 90 | 9 | 0.23 | ○ | ⊙ | ⊙ | Comp. Ex. |
| 132 | 580 | 22 | 1 | 89 | 10 | 0.63 | ○ | ⊙ | ⊙ | Comp. Ex. |
| 133 | 550 | 26 | 1 | 89 | 10 | 0.27 | ○ | ⊙ | ⊙ | Comp. Ex. |
| 134 | 650 | 24 | 1 | 88 | 11 | 0.34 | ○ | ⊙ | ⊙ | Comp. Ex. |
| 135 | 610 | 34 | 6 | 84 | 15 | 0.28 | ○ | Δ | ○ | Comp. Ex. |
| 136 | 600 | 29 | 1 | 89 | 10 | 0.41 | ○ | ⊙ | ⊙ | Comp. Ex. |
| 137 | 610 | 35 | 5 | 94 | 5 | 0.23 | ○ | ⊙ | ○ | Comp. Ex. |
| 138 | 570 | 29 | 1 | 84 | 15 | 0.23 | ○ | Δ | ○ | Comp. Ex. |
| 139 | 630 | 35 | 6 | 92 | 7 | 0.23 | ○ | ⊙ | ○ | Comp. Ex. |
| 140 | 580 | 28 | 1 | 84 | 15 | 0.32 | ○ | Δ | ○ | Comp. Ex. |
| 141 | 580 | 26 | 1 | 89 | 10 | 0.23 | ○ | ⊙ | ⊙ | Comp. Ex. |
| 142 | 560 | 23 | 1 | 89 | 10 | 0.32 | ○ | ⊙ | ⊙ | Comp. Ex. |
| 143 | 630 | 35 | 7 | 88 | 10 | 1.23 | ○ | ⊙ | ○ | Comp. Ex. |
| 144 | 550 | 24 | 1 | 89 | 10 | 0.41 | ○ | ⊙ | ○ | Comp. Ex. |
| 145 | 600 | 26 | 1 | 89 | 10 | 0.21 | ○ | ⊙ | ○ | Comp. Ex. |
| 146 | 620 | 20 | 1 | 90 | 9 | 0.23 | ○ | ⊙ | ○ | Comp. Ex. |
| 147 | 580 | 22 | 1 | 89 | 10 | 0.63 | ○ | ⊙ | ○ | Comp. Ex. |
| 148 | 550 | 26 | 1 | 89 | 10 | 0.27 | ○ | ⊙ | ○ | Comp. Ex. |
| 149 | 650 | 24 | 1 | 88 | 11 | 0.34 | ○ | ⊙ | ○ | Comp. Ex. |
| 150 | 600 | 29 | 1 | 89 | 10 | 0.41 | ○ | ⊙ | ○ | Comp. Ex. |
| 151 | 580 | 26 | 1 | 89 | 10 | 0.23 | ○ | ⊙ | ○ | Comp. Ex. |
| 152 | 560 | 23 | 1 | 89 | 10 | 0.32 | ○ | ⊙ | ○ | Comp. Ex. |
| 153 | 630 | 35 | 7 | 88 | 10 | 1.23 | ○ | ⊙ | ○ | Comp. Ex. |

Note)
In the table, mark_indicates that the value is outside the scope of the present invention.

What is claimed is:

1. A high strength hot-dip galvanized or galvannealed steel sheet having improved plating adhesion and press formability, said stool shoot comprising:

(a) a steel sheet substrate comprising, by weight, carbon (C): 0.05 to 0.2%, silicon (Si); 0.2 to 2.0%, manganese (Mn): 0.2 to 2.5%, and aluminum (Al): 0.01 to 1.5%, said silicon and said aluminum having a mutual relationship represented by formula $$0.4\ (\%) \leqq Si + 0.8\ Al\ (\%) \leqq 2.0\%,$$

said steel sheet substrate further comprising at least one member selected from the group consisting of (i) 0.003 to 1.0% of tin (Sn), (ii) 0.005 to 1.0% in total of at least one member selected from antimony (Sb), bismuth (Bi), and selenium (Se), (iii) 0.005 to 1.0% in total of at least one member selected from beryllium (Be), magnesium (Mg), calcium (Ca), and zirconium (Zr), and (iv) 0.005 to 1.0% in total of at least one member selected from scandium (Sc), yttrium (y), lanthanum (La), and cerium (Ce), with the balance consisting of iron (Fe) and unavoidable impurities, the volume fraction of retained austenite in the steel structure being 2 to 20%; and (b) a zinc (Zn) coated layer provided on said steel sheet substrate.

2. The hot-dip galvanized or galvannealed steel sheet according to claim 1, wherein said steel sheet substrate further comprises, by weight, at least one member selected from nickel (Ni): not more than 2.0%, copper (Cu): not more than 2.0%, and cobalt (Co): less than 0.3%.

3. The hot-dip galvanized or galvannealed steel sheet according to claim 1 or 2, wherein said steel sheet substrate further comprises, by weight, at least one member selected from molybdenum (Mo): less than 0.5%, chromium (Cr):

less than 1.0%, vanadium (V) less than 0.3%, titanium (Ti): less than 0.06%, niobium (Nb): less than 0.06%, and boron (B): less than 0.01%.

4. The hot-dip galvanized or galvannealed steel sheet according to claim 1 or 2, wherein said zinc coated layer is a galvannealed layer comprising zinc (Zn): 80 to 91%, iron (Fe): 8 to 15%, and aluminum (Al): not more than 1%.

5. The hot-dip galvanized or galvannealed steel sheet according to claim 1 or 2, wherein said zinc coated layer is a galvanized layer comprising zinc: not less than 80% and aluminum: not more than 1%.

6. A process for producing the hot-dip galvanized or galvannealed steel sheet according to claim 4, said process comprising the steps of:

providing a cold rolled steel sheet having the chemical composition of the steel sheet substrate as defined in claim 1 or 2;

annealing the cold wiled steel sheet for 10 sec to 6 min in the intercritical temperature range of 650 to 900° C., then cooling the annealed steel sheet to 350 to 500° C. at a cooling rate of 2 to 200° C./sec, and subjecting the cooled steel sheet to hot-dip galvannealing process; and then holding the coated steel sheet in the temperature range of 450 to 600° C. for 5 sec to 2 mm and then cooling the coated steel sheet to 250° C. or below at a cooling rate of not less than 5° C./sec.

7. A process for producing the hot-dip galvanized or galvannealed steel sheet according to claim 4, said process comprising the steps of:

providing a cold rolled steel sheet having the chemical composition of the steel sheet substrate as defined in claim 1 or 2;

annealing the cold rolled steel sheet for 10 sec to 6 min in the intercritical temperature range of 850 to 900° C., then cooling the annealed steel sheet to 350 to 500° C. at a cooling rate of 2 to 200° C. sec, holding the cooled steel sheet in said cooling temperature range for not more than 10 min, and then subjecting the cooled steel sheet to hot-dip galvannealing process; and then holding the coated steel sheet in the temperature range of 450 to 600° C. for 5 sec to 2 min and then cooling the coated steel sheet to 250° C. or below at a cooling sec to 2 min and then cooling the coated steel sheet to 250° C. or below at a cooling rate of not less than 5° C./sec.

8. A process for producing the hot-dip galvanized or galvannealed steel sheet according to claim 5, said process comprising the steps of:

providing a cold rolled steel sheet having the chemical composition of the steel sheet substrate as defined in claim 1 or 2;

annealing the cold rolled steel sheet for 10 sec to 6 min in the intercritical temperature range of 650 to 900° C., then cooling the annealed steel sheet to 350 to 500° C. at a cooling rate of 2 to 200° C. sec, and subjecting the cooled steel sheet to hot-dip galvanizing process; and then cooling the coated steel sheet to 250° C. or below at a cooling rate of not less than 5° C./sec.

9. A process for producing the hot-dip galvanized or galvannealed steel sheet according to claim 5, said process comprising the steps of:

providing a cold rolled steel sheet having the chemical composition of the steel sheet substrate as defined in claim 1 or 2;

annealing the cold rolled steel sheet for 10 sec to 6 min in the intercritical temperature range of 650 to 900° C., then cooling the annealed steel sheet to 350 to 500° C. at a cooling rate of 2 to 200°C./sec, holding the cooled steel sheet in said cooling temperature range for not more than 10 min, and then subjecting the cooled steel sheet to hot-dip galvanizing process; and then cooling the coated steel sheet to 250° C. or below at a cooling rate of not less than 5° C./sec.

* * * * *